US006857301B1

(12) United States Patent
Bergman et al.

(10) Patent No.: US 6,857,301 B1
(45) Date of Patent: Feb. 22, 2005

(54) DISPLACEMENT-TYPE SHAPE SENSOR FOR MULTI-ROLL LEVELER

(75) Inventors: Guil C. Bergman, St. Henry, OH (US); Anthony D. Enneking, Minster, OH (US)

(73) Assignee: Machine Concepts, Inc., Minster, OH (US)

( * ) Notice: Subject to any disclaimer, the term of this patent is extended or adjusted under 35 U.S.C. 154(b) by 5 days.

(21) Appl. No.: 10/414,961

(22) Filed: Apr. 16, 2003

Related U.S. Application Data

(63) Continuation of application No. 10/272,109, filed on Oct. 16, 2002, now Pat. No. 6,769,279.

(51) Int. Cl.[7] ..... B21B 37/28; B21D 1/02

(52) U.S. Cl. ..... 72/11.7; 72/164; 700/154

(58) Field of Search ..... 72/9.1, 11.7, 12.8, 72/164; 700/154, 148; 73/862.07, 862.55

(56) References Cited

U.S. PATENT DOCUMENTS

| | | | | | |
|---|---|---|---|---|---|
| 3,280,921 | A | | 10/1966 | Matsui | 72/168 |
| 3,301,031 | A | | 1/1967 | Bearer | 72/164 |
| 3,499,306 | A | * | 3/1970 | Pearson | 72/11.7 |
| 3,581,536 | A | * | 6/1971 | Terwilliger | 72/8.7 |
| 3,756,050 | A | * | 9/1973 | Kubo et al. | 72/9.1 |
| 3,788,534 | A | * | 1/1974 | Shumaker | 226/4 |
| 3,875,776 | A | | 4/1975 | Morooka | 72/11 |
| 3,902,345 | A | | 9/1975 | Shida | 72/8 |
| 4,188,809 | A | * | 2/1980 | Ishimoto et al. | 72/11.4 |
| 4,454,738 | A | * | 6/1984 | Buta | 72/10.1 |
| 4,512,170 | A | * | 4/1985 | Hsu | 72/11.7 |
| 4,635,458 | A | | 1/1987 | Bradlee | 72/165 |
| 4,651,549 | A | | 3/1987 | Masui | 72/161 |
| 4,674,310 | A | * | 6/1987 | Ginzburg | 72/11.4 |
| 4,680,978 | A | * | 7/1987 | Ginzburg et al. | 73/862.07 |
| 4,715,209 | A | | 12/1987 | Oshima | 72/366 |
| 4,726,213 | A | | 2/1988 | Manchu | 72/366 |
| 5,069,054 | A | | 12/1991 | Hladky et al. | 72/238 |
| 5,535,129 | A | | 7/1996 | Keijser | 364/472 |
| 5,560,237 | A | | 10/1996 | Yasuda et al. | 72/13.4 |
| 5,901,591 | A | | 5/1999 | Kaplan | 72/9.1 |
| 6,216,517 | B1 | | 4/2001 | Hein | 72/236 |
| 6,338,262 | B1 | | 1/2002 | Donini et al. | 72/11.7 |
| 6,658,947 | B1 | * | 12/2003 | Sendzimir et al. | 73/862.451 |

* cited by examiner

*Primary Examiner*—Daniel C. Crane
(74) *Attorney, Agent, or Firm*—Standley Law Group LLP

(57) ABSTRACT

A displacement-type shape sensor for detecting the flatness of a strip of material. A flatness detection system may be formed from a plurality of said sensors. The displacement-type shape sensor preferably employs a roller bearing coupled to an actuator. A linear displacement sensor is coupled to the actuator/roller bearing to measure linear displacement. Preferably, the displacement-type sensor(s) is located below the strip of material and placed in contact therewith by movement of the actuator. By measuring the amount that the roller bearing(s) is displaced, it is possible to detect the flatness of the strip. Through use of a plurality of such sensors, areas of varying tension and, thus, areas of differing flatness of the strip of material may be detected. The displacement-type shape sensor may be used in conjunction with a precision leveler to effectuate leveling of the strip of material. The sensor(s) may communicate with an automatic shape control system of the leveler to provide for automatic correction of the leveling process.

44 Claims, 23 Drawing Sheets

DISPLACEMENT-TYPE SHAPE SENSOR FOR MULTI-ROLL LEVELER

This application is a continuation of U.S. patent application Ser. No. 10/272,109, filed on Oct. 16, 2002, now U.S. Pat. No. 6,769,279.

BACKGROUND AND SUMMARY OF THE INVENTION

The present invention relates to a leveler for the flattening and stress reduction of a metal strip. More specifically, the present invention is a multi-roll leveler with built-in shape control. The leveler is particularly useful, for example, in conjunction with the rolling process often utilized in the manufacturing of metal strip products.

During the manufacturing of metal sheet or strip products, various materials are combined, heated, and transformed into a molten metal compound. The molten metal is then generally molded into specific shapes, such as slabs or billets. The molded shapes may then be transported to a hot rolling mill where they can be rolled into thinner products. The molded shape may be reheated in a furnace prior to the rolling process. A molded shapes may be passed through the rolling mill multiple times. The rolling mill may convert the molded shape, typically a slab, into a thin sheet, which may then be rolled into a coil for easier handling and transport.

The hot rolling mill is useful for reducing the thickness of the molded metal slabs, and thereby producing metal strip. However, the hot rolling process may also impart undesirable shape defects to the resulting metal strip. Hot rolling mills typically flatten and thin the strip by passing it under a series of rolls. The rolls are caused to exert a force on the strip as it passes therebeneath. However, it is difficult to exert a uniform force across the width of the strip during the hot rolling process. Consequently, the finished strip may possess undesirable shape defects. These shape defects are commonly the result of stresses developed within the strip as it passes through a rolling mill and is subjected to the non-uniform application of force across its width, thereby leading to a non-uniform stretching of the length of the strip.

In light of the deficiencies of known hot rolling mills, precision levelers have been developed to equalize the length and relieve internal stresses present in the strip, thereby producing a flatter and more desirable product. These levelers are typically of two varieties: multi-roll levelers and tension levelers. Multi-roll levelers generally use opposing, substantially parallel sets of work rolls that often are supported by back-up rolls. During operation, the metal strip material is caused to pass between the opposing sets of work rolls. Each set of work rolls is placed into contact with the metal strip, such as by driving one set of work rolls toward the other, so that a leveling (flattening) force is impressed upon the metal strip as it passes therebetween. The metal strip material, which is commonly supplied in coil form, is uncoiled and fed into the entrance of the leveler. The work rolls operate to relieve any stresses induced by the hot rolling process, and to thereby impart flatness across the entire width of the strip. In contrast, tension leveling works by stretching the strip between two sets of rolls. Each set of rolls is able to grip the strip, and as the rolls rotate, tension is created in the strip. As the strip is stretched, shorter areas of the strip will become longer, and eventually uniform length and substantial flatness will be achieved across the width of the strip. As the present invention relates to a multi-roll leveler, tension leveling need not be discussed in further detail herein.

The work rolls of a multi-roller leveler are typically designed to allow for bending during operation of the leveler in order to compensate for fluctuations in the profile of the metal strip. Bending is typically accomplished by using a plurality of adjusting means, such as wedges or other force exerting devices, to act on the backup rolls and, thereby, the work rolls. The adjusting means may be positioned by motor-driven jack assemblies, or other types of actuators. Because the adjusting means are generally distributed substantially across the width of the leveler, they can be used to impart a localized, non-uniform bending force on the work rolls. As such, the work rolls can be made to contact only the necessary portions of the metal strip or, to exert more or less force on particular areas of the strip.

When using a multi-roller leveler, it is necessary to determine the cross-sectional shape and, thus, the stress distribution of the strip. In known levelers, this is accomplished by manually sampling the strip and then manually setting the work rolls of the leveler accordingly. The leveler then operates on the entire strip according to the profile derived from the head or tail of the strip. This is problematic because such a manual sampling may not be truly indicative of the shape and stresses that exist along the entire length of the strip. For example, the shape defects that occur at the head or tail of the coil may not remain constant over the length of the strip. Consequently, while a portion of the strip may be properly leveled using the initial leveler settings, defects in other portions may remain. Therefore, it is desirable to be able to continuously sample the strip and adjust the leveler accordingly, so that variations in shape and stress encountered along the length of the strip are properly treated.

The present invention provides this ability. The present invention consists of a multi-roll leveler having a closed-loop control system. The leveler of the present invention utilizes a shape sensor located at the exit thereof. The shape sensor measures the stresses present in and, thus, the flatness across the width of the strip. Shape sensor readings are fed back to a microprocessor-based controller that uses the readings to ascertain and initiate necessary changes to one or more of various leveler settings. The shape sensor is preferably disposed substantially across the width of the leveler, and may be divided along its length into a number of individual measurement segments. In one particular embodiment of the precision leveler of the present invention, there are also preferably a number of work roll adjusting means disposed along the width of the leveler, such as, for example, the motor-driven jack assemblies and adjusting wedge pairs discussed above. One or more of the shape sensor measurement segments forms a measurement zone along a portion of the width of the metal strip. At least one measurement zone is preferably associated with each of the plurality of work roll adjusting means. A stress (flatness) measurement is taken by each segment of the measurement zone. The individual measurements may be averaged together or otherwise analyzed to determine the corresponding stress existing in the zone. The stress present within the particular measurement zone of the metal strip is then used by the leveler's control system to calculate the amount of penetration of the work rolls necessary to flatten the metal strip in the measurement zone. The associated work roll adjusting means is then actuated to position the work rolls accordingly. This procedure is followed for each measurement zone across the length of the shape meter and the width of the metal strip. The leveler's control system may also adjust the entry and exit gaps of the leveler in response to measurement zone readings from the shape sensor. For example, the control system may signal entry and/or exit jack screws or similar devices located on the leveler, to increase or decrease the entry or exit gap between the sets of work rolls. Entry and exit gap adjustment can be used to further assist in flattening the metal strip. The shape sensor continuously monitors the treated metal strip and sends the measurement information to the leveler's control system. The closed-loop control system then adjusts the work rolls and/or entry and/or exit gaps as needed to compensate for changes in the profile of the strip. In this manner, coil-to-coil variance is improved, head scrap is reduced, and the material yield required to produce a flat strip is minimized.

BRIEF DESCRIPTION OF THE DRAWINGS

In addition to the features mentioned above, other aspects of the present invention will be readily apparent from the following descriptions of the drawings and exemplary embodiments, wherein like reference numerals across the several views refer to identical or equivalent features, and wherein.

DETAILED DESCRIPTION OF THE EXEMPLARY EMBODIMENT(S)

Figure 1:
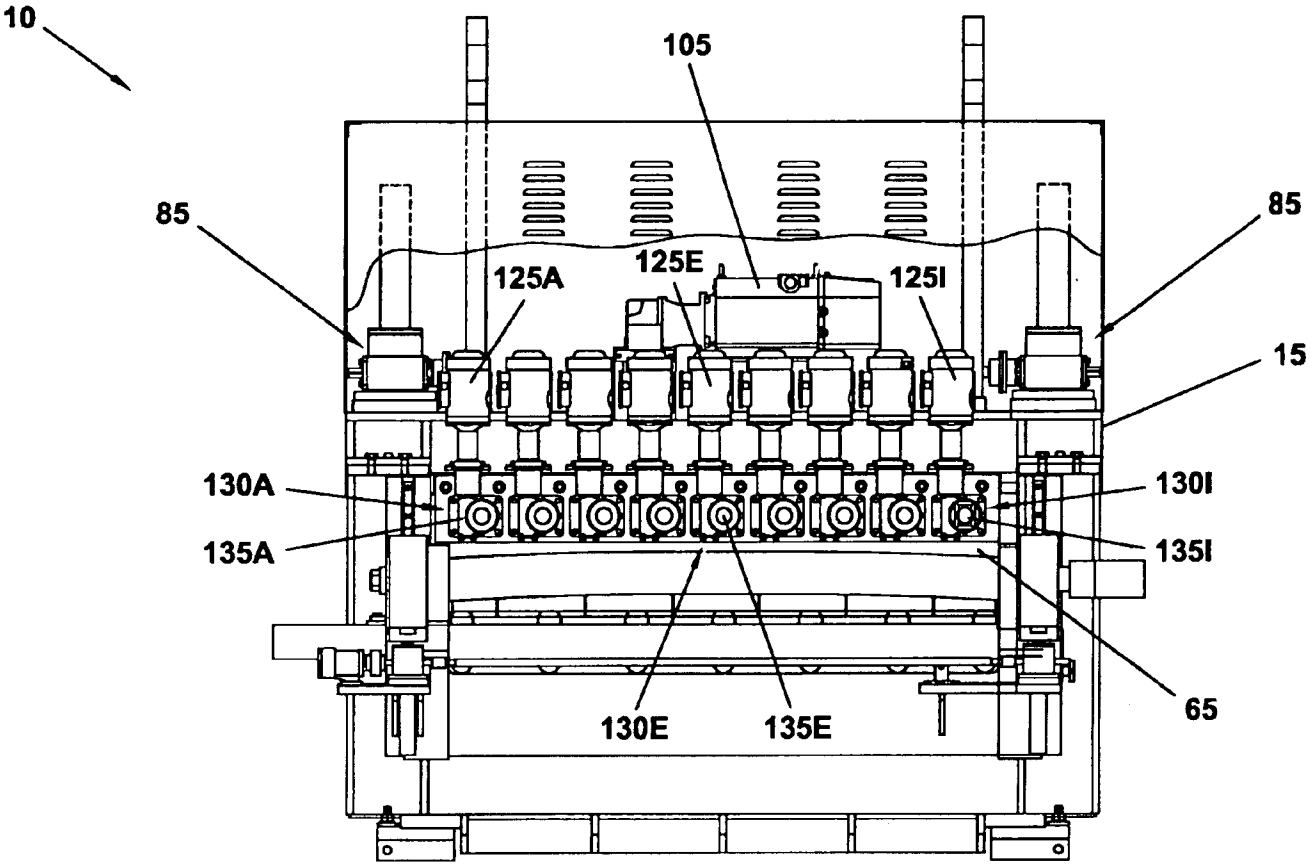
FIG. 1 is a front elevational view depicting an entry side of one embodiment of a leveler with automatic shape control according to the present invention.
Figure 2:
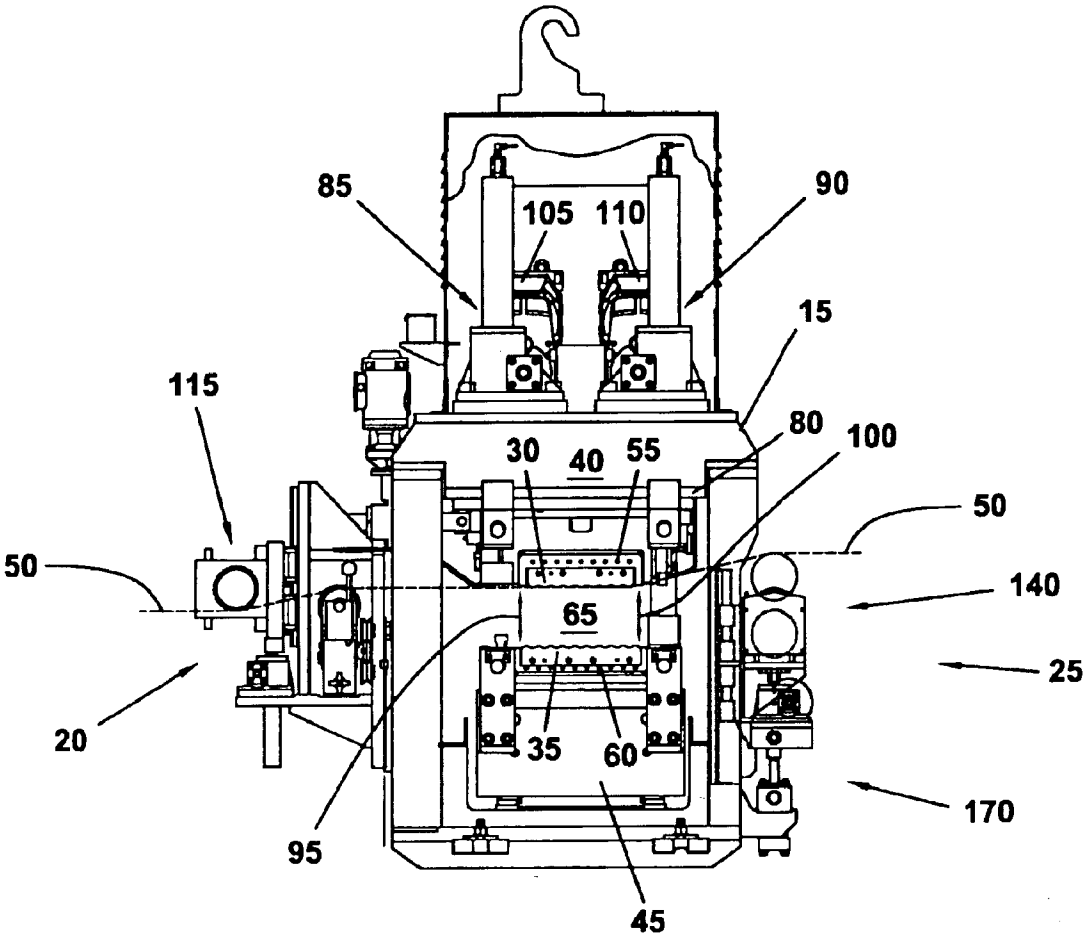
FIG. 2 is a right side elevational view of the leveler with automatic shape control of FIG. 1.
Figure 3:
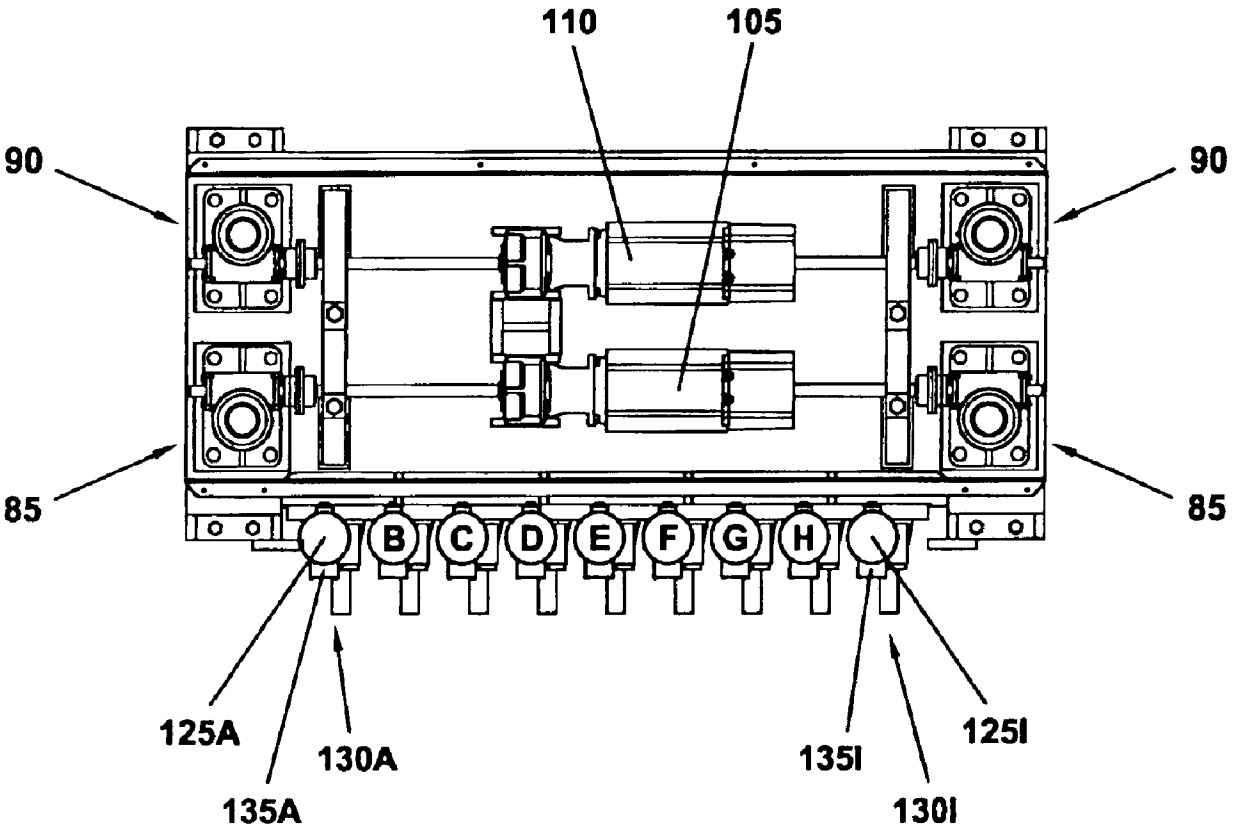
FIG. 3 is a top plan view of the leveler portion of the leveler with automatic shape control of FIG. 1, wherein a feed section and a flatness measurement section have been deleted for reasons of clarity.
Figure 4:
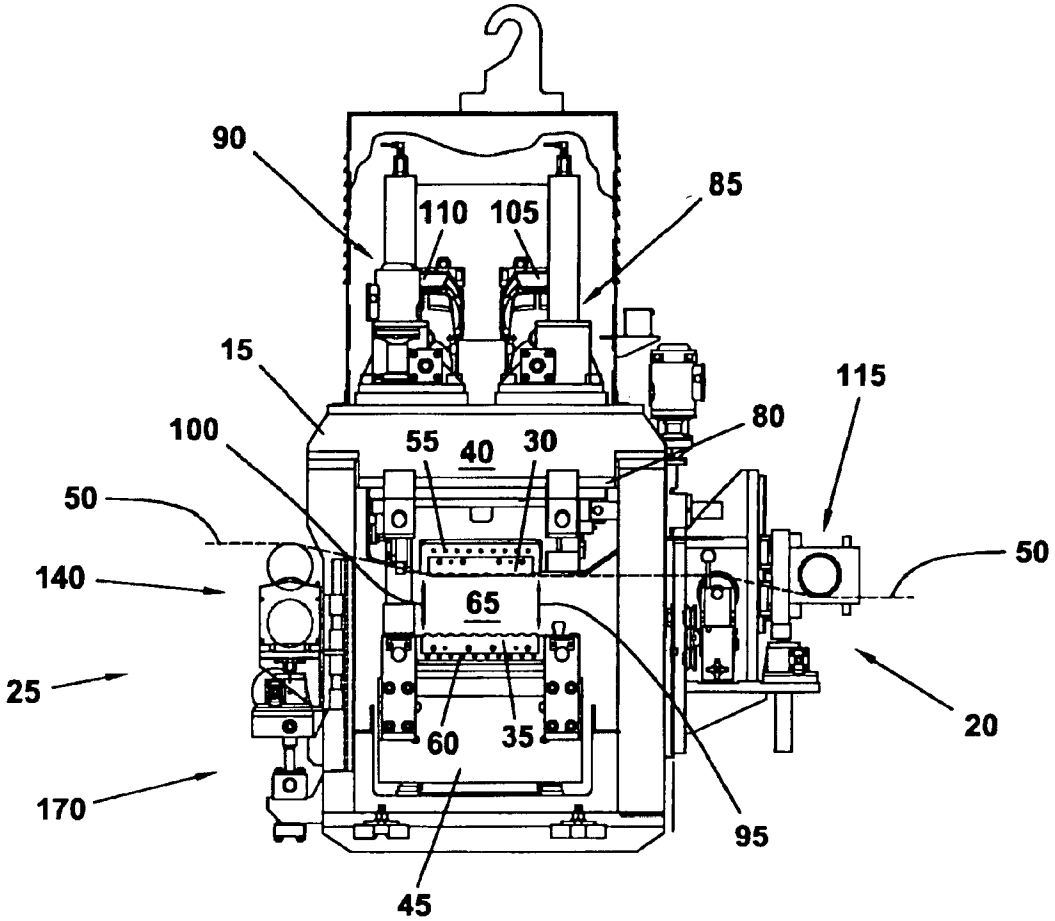
FIG. 4 is a left side elevational view of the leveler with automatic shape control of FIG. 1.

An exemplary embodiment of a leveler with automatic shape control 10 can be seen in FIGS. 1–7. The leveler 10 is shown to include a frame 15. The leveler 10 has an entry 20 and an exit 25 side. A top and bottom set of work rolls 30, 35 are disposed between a set of platens 40, 45 within the frame 15 of the leveler 10, such that they reside between the entry 20 and exit 25 thereof. The sets of work rolls 30, 35 are provided to flatten the metal strip material 50 that will be passed through the leveler 10.

In this embodiment of the present invention, each set of work rolls 30, 35 is supported by a set of backup rollers 55, 60—although it may also be possible to eliminate the backup rollers in other embodiments. In this particular embodiment of the leveler 10, the backup rollers 55, 60 are segmented, so that each work roll is actually supported by a plurality of individual backup rollers. A working envelope 65 is formed within the leveler 10 between the entry 20 and exit 25 side thereof. The sets of work rolls 30, 35 are arranged in a substantially parallel relationship between the entry 20 and exit 25 side of the leveler 10, with the longitudinal axis of each work roll oriented substantially perpendicular to the direction of travel of the metal strip 50 that will be passed therethrough.

Figure 5A:
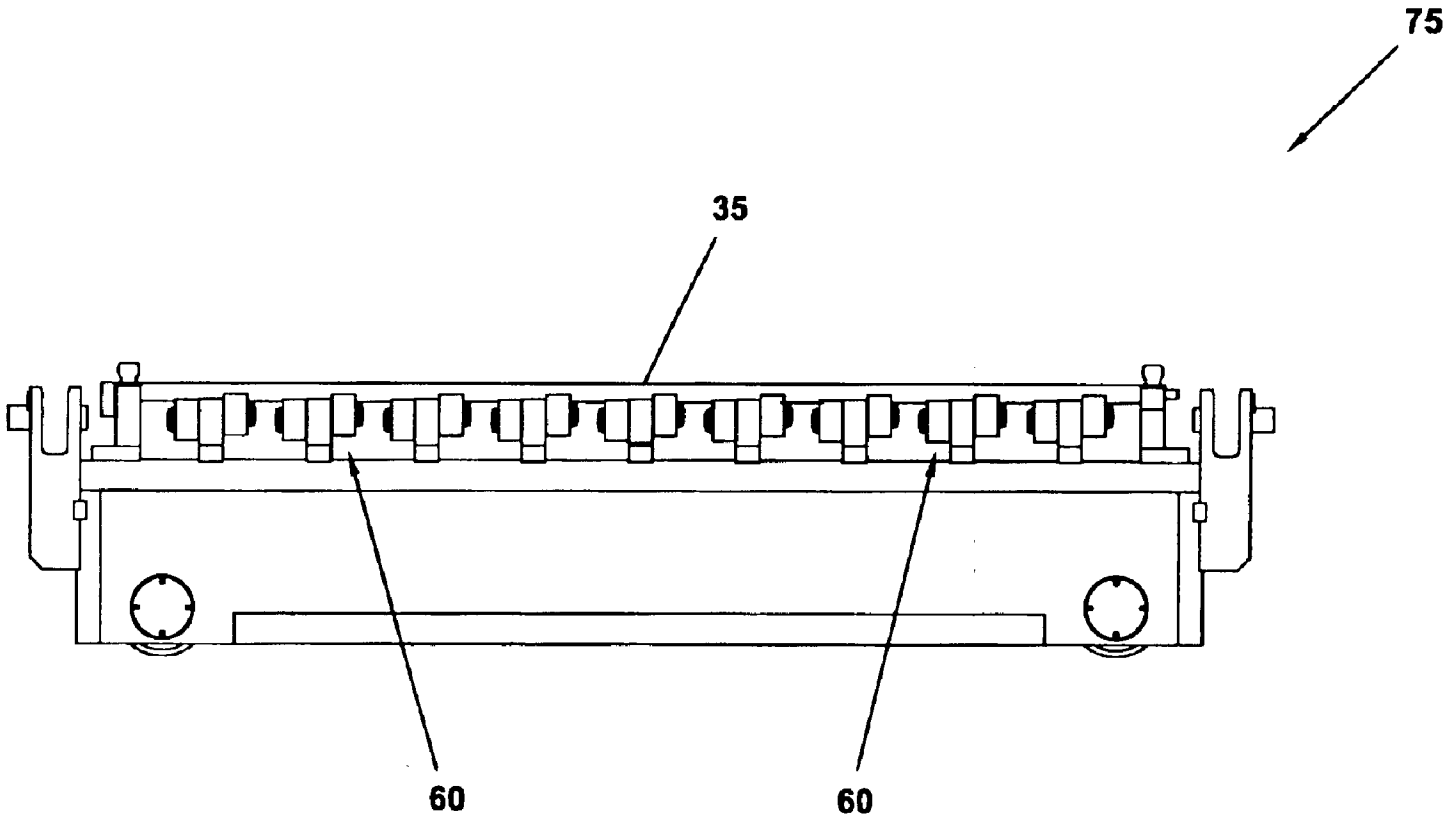
FIG. 5*a* is a front elevational view of an upper cassette assembly containing work rolls and backup rolls as used in the leveler with automatic shape control of FIG. 1.
Figure 5B:
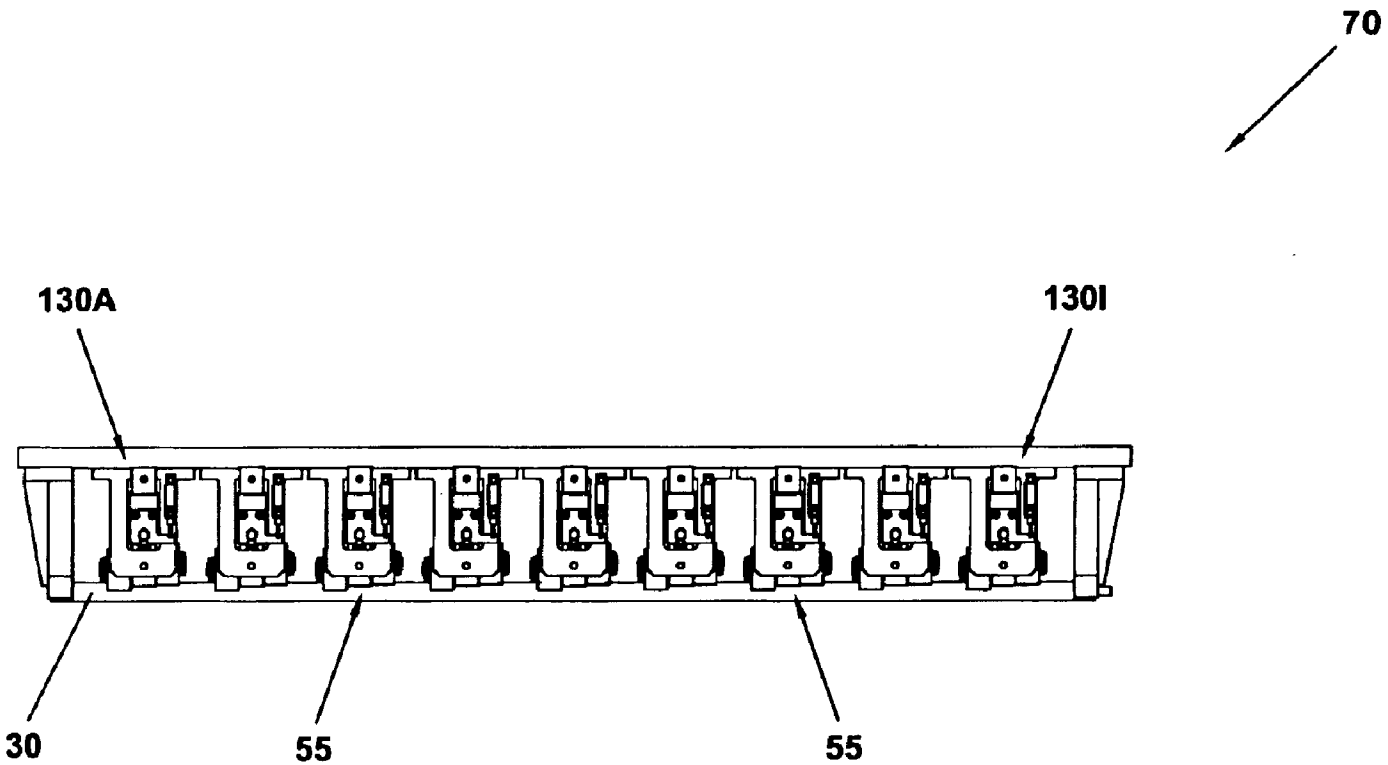
FIG. 5*b* is a front elevational view of a lower cassette assembly containing work rolls and backup rolls as used in the leveler with automatic shape control of FIG. 1.
Figure 6:
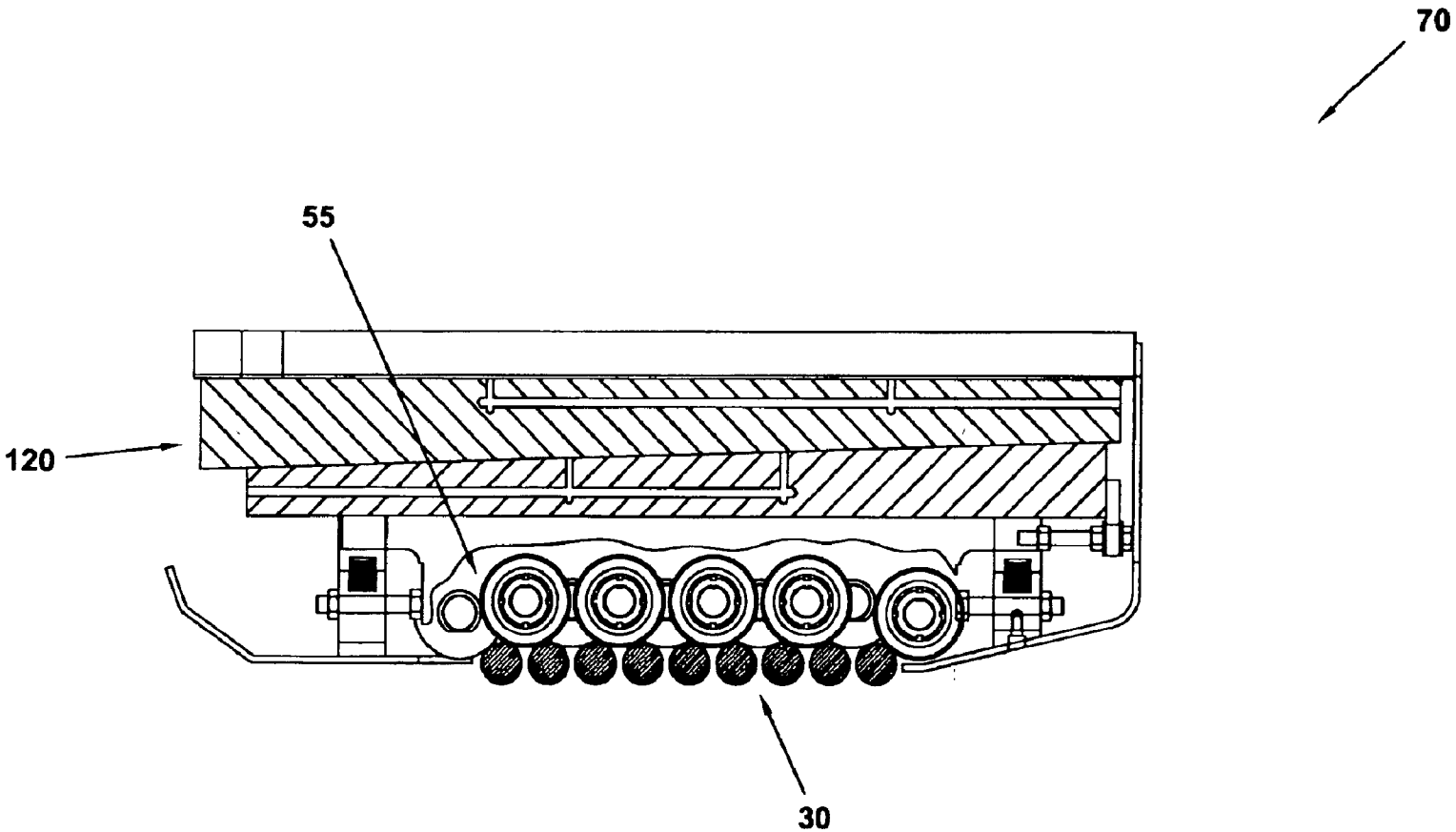
FIG. 6 is an enlarged right side view, in partial cross-section, of a wedge-type adjusting means employed in one embodiment of a leveler with automatic shape control of the present invention.

As can be seen by specific reference to FIGS. 5*a* and 5*b*, each of the upper and lower sets of work rolls 30, 35 and their corresponding sets of backup rollers 55, 60 are preferably disposed within a removable upper and lower cassette assembly 70, 75, respectively. In this embodiment, the lower cassette 75 preferably hangs from an entry and exit jack assemblies 85, 90 that passes through the leveler frame 15. The hanging design of the lower cassette assembly 75 allows gravity to assist in the reduction caused by the separating forces produced between the upper and lower sets of work rolls 30, 35 during operation of the leveler 10. Thus, the hanging design of the lower cassette assembly 75 minimizes mechanical backlash during operation of the leveler 10. The hanging design of the lower cassette 75 is also advantageous because the separating forces generated during the leveling process are transmitted primarily to the entry and exit jack assemblies 85, 90, in tension, and not through the leveler frame 15. This also allows the leveler 10 to have only an upper bolster 80, rather than an upper and lower bolster as is typically required. In this embodiment, the upper cassette assembly 70 is mounted within the leveler 10 in a stationary manner. To effect removal of the cassette assemblies, the upper cassette 70 may be brought substantially into contact with the lower cassette 75, whereafter, both cassettes may be detached from the leveler platens 40, 45 and rolled or otherwise removed from the leveler 10, such as by means of a moveable cart.

An entry and exit gap 95, 100 are provided between the upper and lower cassette assemblies 70, 75 to allow the metal strip 50 to pass therethrough. The entry gap 95 and the exit gap 100 of the leveler 10 may be independently adjusted. In this particular embodiment of the leveler, a pair of vertically oriented jack assemblies 85, 90 are employed to independently adjust each of the entry and exit gaps 95, 100 by adjusting the position of the upper cassette assembly 70. A motor 105, 110 is utilized to drive each jack assembly pair 85, 90. In this embodiment, the motors used are electric motors, although other types of motors may also be successfully employed. Each motor 105, 110 is used to turn a pair of machine screws (not shown) located within its corresponding jack screw assembly 85, 90. The machine screws pass through a receiving portion of the upper cassette assembly 70. Rotation of the threaded machine screws causes a change in the vertical position of the upper cassette assembly 70. It is also contemplated to replace the motor-driven jack assemblies 85, 90 with hydraulic cylinders or other suitable actuating devices in order to adjust the entry and exit gaps 95, 100 between the cassette assemblies 70, 75.

The entry side 20 of the leveler 10 is designed to receive a supply of the metal strip material 50. A passline roll 115 is preferably located at the entry 20 side to the leveler 10 to help guide the metal strip into the work rolls 30, 35. The metal strip 50 is typically supplied from a coil (not shown) located nearby. The entry gap 95 of the leveler 10 is adjusted to some predetermined height (which will typically be considerably less than that shown in the drawing figures) prior to the feeding of the metal strip 50. The initial entry gap 95 setting may be based on a variety of parameters, not limited to, the thickness, yield strength, modulus of elasticity, and coil feed speed of the entering metal strip 50, as well as other relevant parameters. For example, the entry gap 95 may be set according to the following exemplary formula:

$$POS_{(Entry\ Gap)} = \left(\frac{\text{Yield} \times (\text{Center})^2}{12 \times (1 - \%\ \text{Yield}) \times (\text{Thickness})/2) \times \text{Modulus}}\right) - \text{Thickness}$$

The exit gap 100 of the leveler 10 is also set to a predetermined height prior to treatment of the metal strip 50. The height of the exit gap 100 is typically set to be substantially equal to the thickness of the metal strip 50, although the exit gap may also be set to provide for penetration of the metal strip material. Once the entry and exit gaps 95, 100 are set, the metal strip material 50 is fed into the leveler 10. Upon entering the work envelope, the work rolls 30, 36 will act to treat shape defects and relieve stresses existent within the metal strip 50. Preferably, the work rolls 30, 35 are arranged such that the metal strip 50 is forced to bend some distance around substantially each roll thereof, in a serpentine fashion. This bending of the metal strip 50 around the work rolls 30, 35 is commonly referred to as wrap angle. As the entry gap 95 is generally set to provide more penetration of the work rolls 30, 35 into the metal strip 50 material near the entry side of the leveler 10, the wrap angle of the metal strip will typically decrease as the metal strip moves across the work rolls.

Because shape defects and stresses within the metal strip 50 may vary across its width, the work rolls 30, 35 will typically need to apply a non-uniform force thereto. Consequently, the leveler 10 is preferably designed to provide for a bending of one or more areas of each individual work roll of the work roll sets 30, 35. To achieve the necessary bending of the work rolls 30, 35, a work roll adjusting means is provided. In this particular embodiment of the leveler 10, the work roll adjusting means consists of multiple sets of adjusting wedge pairs 120 (see FIG. 6), although other types of work roll adjusting means may also be utilized. The adjusting wedge pairs 120 reside above the backup rollers 55 in the upper cassette assembly 70, and are disposed substantially across the width of the work envelope 65. More specifically, the set of adjusting wedge pairs 120 are shown to be disposed substantially along the entire length of the upper work rolls 30, with the longitudinal axes of the adjusting wedges oriented substantially perpendicularly to the longitudinal axes of the work rolls 30. In this particular embodiment of the leveler 10, the adjusting wedge pairs 120 are integrated into only the upper cassette assembly 70 and, thus, only the upper work rolls 30 may be bent thereby. However, other embodiments of a leveler according to the present invention may be provided with adjusting wedges or other work roll adjusting means that allow for bending of only the lower set of work rolls 35, or for bending of both sets of work rolls.

Bending of the upper work rolls 30 at a particular location can be accomplished by causing movement of the proper adjusting wedge pair of the set of adjusting wedge pairs 120. Movement of individual wedges in this embodiment of the leveler 10 is accomplished by using an electric motor 125A–125I and a corresponding wedge adjusting assembly 130A–130I. In this embodiment of the leveler 10, an electric motor 125A–125I is provided for each wedge pair of the set of adjusting wedges 120. Each electric motor 125A–125I is preferably coupled to a speed reducer 135A–135I, and is disposed at substantially a right angle to a corresponding machine screw (not shown) residing within the wedge adjusting assemblies 130A–130I. One end of the machine screw is coupled to the upper wedge of an adjusting wedge pair, such that the upper wedge may be horizontally displaced by rotation of the machine screw. Horizontal displacement of the upper wedge translates into the exertion of a bending force on the corresponding area of each of the upper work rolls 30 lying subjacent thereto. Each of the electric motors 125A–125I, speed reducers 135A–135I and machine screws of the adjusting wedge assemblies 130A–130I used to cause a bending of the work rolls 30, are adapted to move vertically along with the upper cassette assembly 70. Displacement of the adjusting wedges within the adjusting wedge set 120 using a different type of actuator, such as, for example, a hydraulic or pneumatic cylinder, is also contemplated according to the present invention.

In this particular embodiment of the leveler 10 of the present invention, an air-bearing shape meter 145 is employed as a shape sensor 140. Preferably, the shape meter 145 or other shape sensor is integral to the leveler 10, and is located at the exit 25 side thereof. Preferably, an unbent entry roll is also provided between the last bending work roll of the upper set of work rolls 30 and the shape meter 145 or other shape sensor, to ensure that an unloaded metal strip 50 is presented thereto. Similarly, an unbent exit roll is preferably provided between the shape meter 145 or other shape sensor and a downstream re-coiler (not shown). The downstream re-coiler rewinds the flattened strip 50 and maintains tension in the strip as it leaves the exit of the leveler 10. Both the entry roll and the exit roll help to remove the effects of any externally applied forces from the metal strip 50.

The shape meter 145 or other shape sensor 140 is provided to measure the stress distribution in and, therefore, the flatness across the width of the metal strip 50. One embodiment of a shape meter 145 that can be used in the present invention can be seen in FIGS. 6–7*c*. This embodiment of the shape meter 145 operates by measuring the force exerted on various measurement zones 150 that are disposed along its length. Each measurement zone 150 may be comprised of a plurality of individual shape meter sensing segments 155. Each measurement zone 150 also preferably corresponds to one or more of the adjusting wedge pairs of the set of adjusting wedges 120, as well as to one of the wedge adjusting assemblies 130A–130I (see FIG. 7*a*). In this particular embodiment of the leveler 10, the shape meter 145 utilizes a segmented rotating roll 160. Each of the sensing segments 155 of the shape meter 145 is comprised of an air bearing-supported sensor 165. In the particular embodiment of the shape meter 145 illustrated in FIG. 6, there are 26 sensing segments 155 disposed along the length thereof. However, it should be realized that the number of shape meter sensing segments 155 may be altered as necessary to accommodate a particular width of metal strip 50, or to provide a desired measurement resolution.

A stress measurement is taken by each sensing segment 155 of each measurement zone 150 of the shape meter 145. The air bearing-supported sensors 165 that make up each sensing segment 155 of this particular shape meter 145 are of known design, and are constructed with an outer ring and a supporting arbor. Between the outer ring and supporting arbor is a zone of pressurized air. Stress measurements are generated by measuring the changes in the pressure within the pressurized air zone, which result from the force exerted on the outer ring by the metal strip 50 as it passes over the segmented rotating roll 160 of the shape meter 145. The individual segment measurements may be averaged together to determine the stress at each measurement zone 150, and the result used by the leveler's control system to adjust the corresponding work roll adjusting means (e.g., the adjusting wedge set 120 and adjusting wedge assemblies 130A–130I discussed above). This procedure is followed for each measurement zone 150 and work roll adjusting means disposed across the width of the strip 50. Individual sensing segments 155 may be shared by adjacent measurement zones 150. The shape meter 145 continuously measures the leveled strip 50 and sends the measurement information to the leveler's control system. The control system then adjusts (bends) the upper work rolls 30 as needed to compensate for changes in the profile of the strip 50. The control system may also adjust the entry and/or exit jack 85, 90 if necessary to effect proper flattening of the metal strip 50. In this manner, coil-to-coil variance is improved, head scrap is reduced, and the material yield required to produce a flat strip is minimized.

Proper engagement of the shape sensor 140 with the metal strip may be made by a variety of means, including by manual adjustment. In one particular embodiment of the present invention, however, proper engagement of the shape sensor 140 with the metal strip 50 is automatically accomplished. As can be best observed by reference to FIGS. 2, 4 and 7*a*–7*c*, an automatic shape sensor engagement system 170 is contemplated by the present invention. In this particular embodiment of the present invention, the automatic shape sensor engagement system 170 is coupled to the shape meter 145. The automatic shape sensor engagement system 170 is particularly well suited for use with the air bearing-employing shape meter 145, because the air bearings are force sensitive. For example, if too great a force is exerted by the strip 50 as it passes over the air bearings of the shape meter 145, damage to the air bearings may result. In contrast, if too little force exists between the air bearings and the traversing metal strip 50, the shape signal generated by the shape meter 145 may provide inadequate feedback to the automatic shape control system.

Figure 7A:
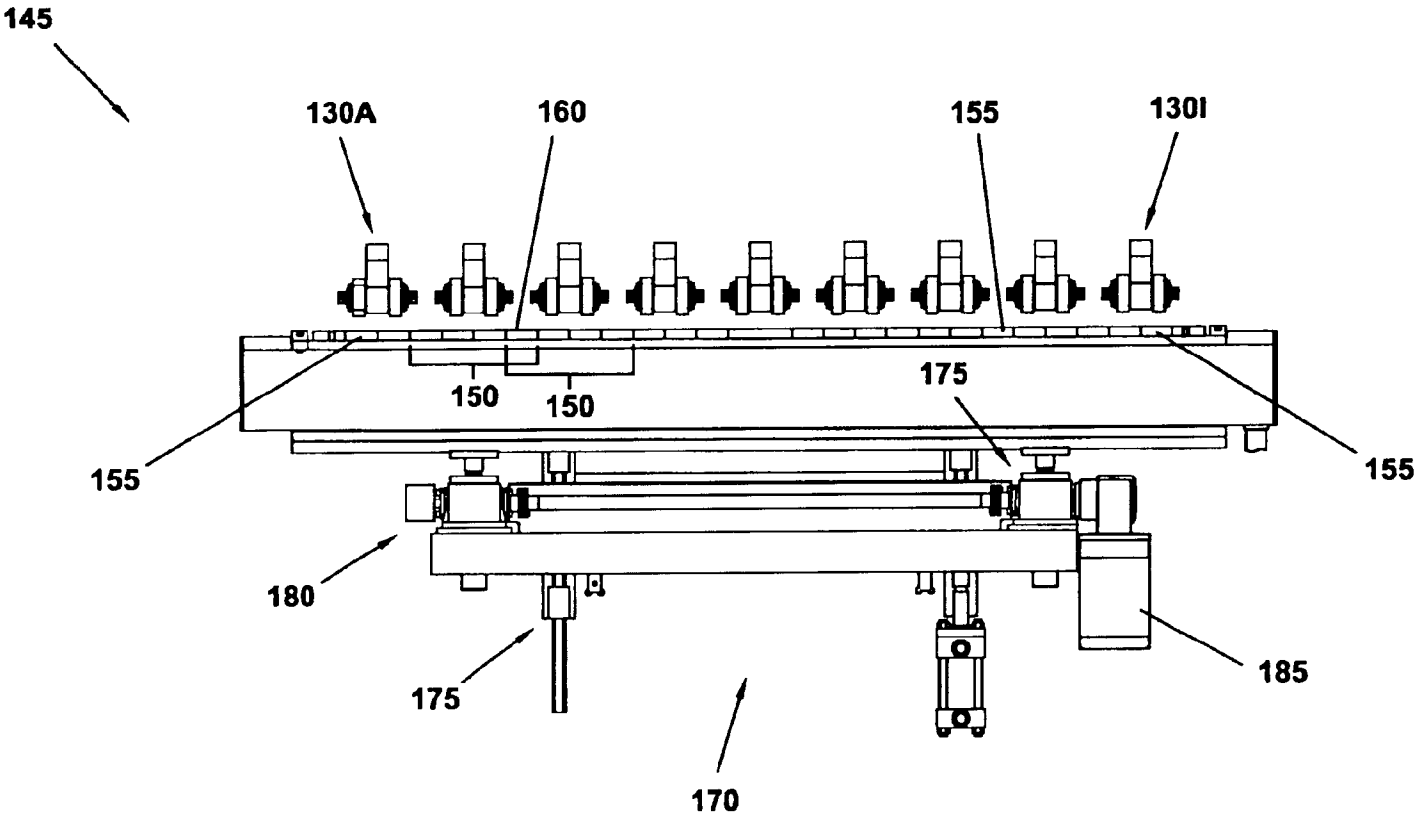
FIG. 7*a* is a front elevational view of a shape meter used as a shape sensor in one embodiment of a leveler with automatic shape control according to the present invention.
Figure 7B:
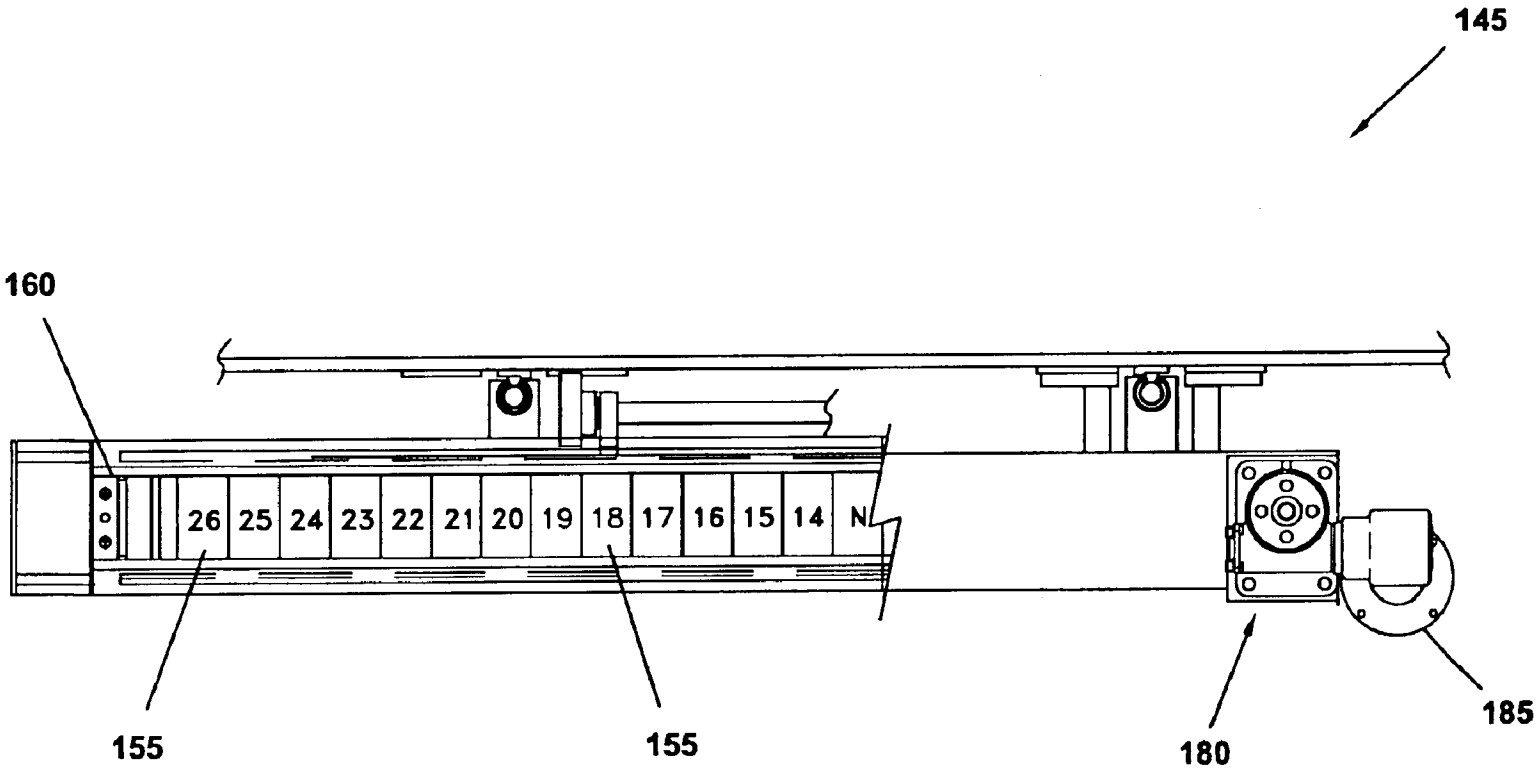
FIG. 7*b* is a top plan view of the shape meter of FIG. 7*a;*
Figure 7C:
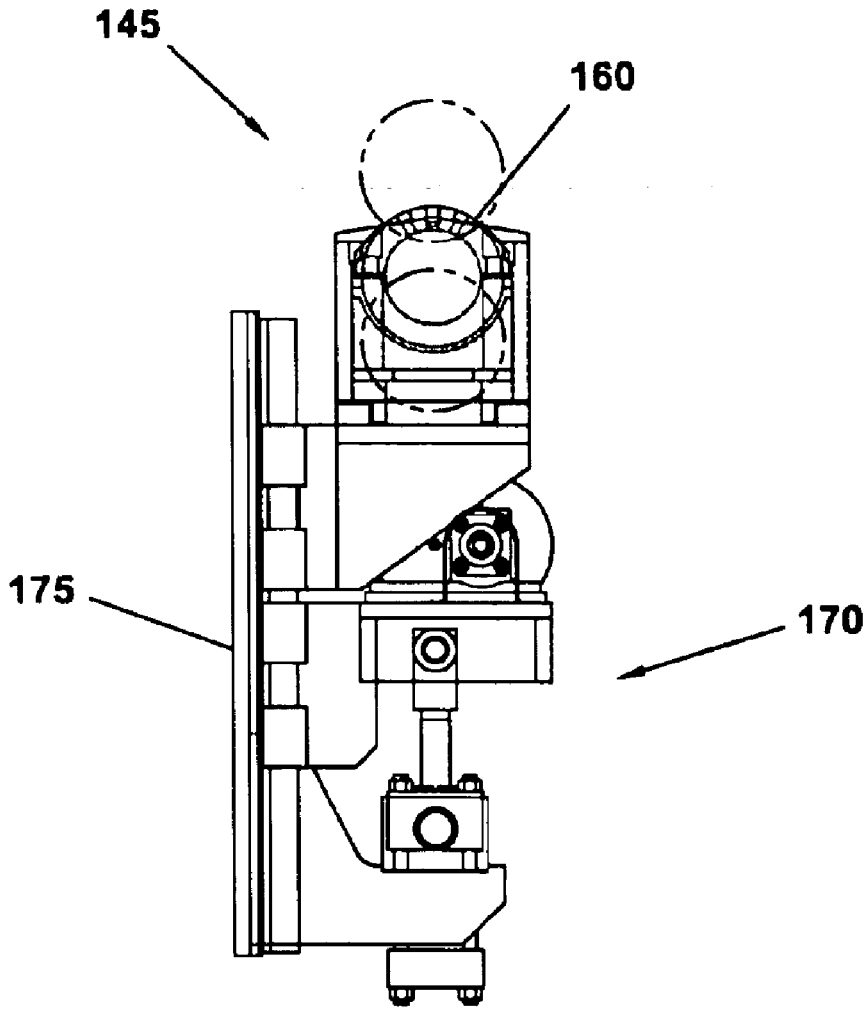
FIG. 7*c* is a left side elevational view of the shape meter of FIG. 7*a;*

The automatic shape sensor engagement system 170 provides for automated vertical position adjustment of the shape sensor 140 (see FIG. 7*c*). In the embodiment shown, the shape meter 145 is utilized as the shape sensor. The shape meter 145 rides on a pair of linear guide rails 175 to maintain proper alignment thereof during vertical motion. A pair of shape sensor jack assemblies 180 are also provided to produce vertical position adjustment of the shape meter 145. In this embodiment, the shape sensor jack assemblies 180 are driven by an electric motor 185. Preferably, the shape sensor jack assemblies 180 are mechanically connected so both machine screws located therein will move a linearly equal amount when the motor 185 is actuated. Consequently, mechanically connecting the shape sensor jack assemblies 180 ensures that the shape sensor 140 will be maintained in proper parallel alignment with the strip 50 as it is raised or lowered by the motor 185. The peak and average forces exerted on each sensing segment 155 of the shape meter 145 or other shape sensor 140 are preferably monitored, and the data collected is fed back to the automatic shape control system. The automatic shape control system will then signal the motor 185 to raise or lower the shape meter 145 or other shape sensor 140 as necessary to maintain the force exerted thereon by the strip 50 at or near a target value. While the automatic shape sensor engagement system 170 has been described as using an electric motor 185 coupled to a pair of interconnected shape sensor jack assemblies 180, it should be realized that actuators such as air or hydraulic cylinders, for example, could be used in the alternative to provide the necessary vertical movement of the shape sensor, and such is considered within the scope of the present invention. Additionally, the above embodiment is provided only for purposes of illustration, and is not intended to limit the automatic shape sensor engagement system 170 to use with the shape meter 145. Rather, it is contemplated that the automatic shape sensor engagement system 170 could be used with a variety of shape sensors.

Automatic shape control of the leveler 10 is achieved through the use of a microprocessor-based control system. An algorithm has been developed for providing proper control of the leveler 10. For the metal strip 50 to be flat, all sections of the strip must be substantially the same length. Any longer sections of the strip 50 will produce a buckle or wave. Because longer sections cannot be made shorter, any shorter sections must be made longer if the metal strip 50 is to be flat. Making all sections of the strip 50 the same length, and thereby reducing or eliminating stresses existing therein, is the goal of the control algorithm—as doing so will produce a flat strip. The control algorithm operates to maintain a minimum elongation of the metal strip 50, whereby working the shorter strip sections preferably does not produce a further elongation of the longer sections of the strip.

In operation, the leveler 10 is prepared to receive the metal strip 50. If not already known, the metal strip 50 is examined to determine its approximate thickness (gage), width, and profile, although the thickness and width are typically known. The yield strength, modulus of elasticity, and maximum allowable work roll penetration of the metal strip 50 material is also generally known. From this information, the anticipated percent yield required for leveling can also be ascertained. The entry gap 95 is then adjusted to an initial dimension based on these factors. Similarly, the exit gap 100 is typically set to be substantially equal to the thickness of the metal strip 50, although penetration-producing settings may also be employed if necessary. If the width of the metal strip 50 is less than the width of the work envelope, any work roll adjusting means (e.g., adjusting wedge pairs and corresponding wedge adjusting assemblies 130A–130I) that fall outside the width of the metal strip will be unused, and are preferably retracted upward. Preferably, each of the unused work roll adjusting means is retracted to a position that is at least approximately 50 percent of its fully retracted position. Retracting the work roll adjusting means prevents the undesirable interaction thereof with the remaining work roll adjusting means that will be used. Each of the work roll adjusting means that reside within the boundaries of the width of the metal strip 50 are preferably initially set to a "zero" position—a position wherein the work roll adjusting means will not cause either a positive or negative bending of the upper work rolls 30.

During initial feeding of the metal strip 50 through the leveler 10, there will be a brief transport delay between the leveler section and the shape meter 145, or other shape sensor 140. Once the supply speed of the metal strip 50 increases sufficiently to overcome this delay, the automatic control system begins to operate the leveler 10. Once the closed-loop automatic control system is operative, leveler settings are controlled in response to the stress measurement signals received from the shape sensor 140. The goal of the control system is to produce a stress measurement of zero at each measurement zone 150 disposed across the length of the shape sensor 140—at which point, the metal strip will be flat 50.

Variations in the length of the metal strip 50 will cause tension therein. When a positive tension within the metal strip 50 is detected by the shape sensor 140, the control system acts to flatten that section of the strip. To accomplish the flattening of a section of the metal strip 50 having a positive tension, the control system signals the work roll adjusting means that corresponds to that particular section of the metal strip to adjust its position accordingly. In the particular embodiment of the leveler 10 shown, the control system initiates a movement of one or more wedge pairs of the adjusting wedge set 120. The adjusting wedge movement translates into a bending of the associated portion of the upper work rolls 30. Different combinations of work roll adjusting means movement can produce a greater or lesser penetration of the work rolls 30, 35 into the targeted portion of the metal strip 50 material. In response to positive bending, the bent portion of the upper work rolls 30, will produce a force that results in a stretching of the metal strip 50. As the appropriate sections of the metal strip 50 are stretched, the overall length of the strip becomes more uniform. As the section of the metal strip 50 exhibiting a positive tension is acted upon by the work rolls 30, 35, the stresses associated therewith are reduced and the section of the strip is flattened. Similarly, when a section of the metal strip 50 exhibiting a negative tension is detected, the control system signals the appropriate work roll adjusting means to impart a negative bending to the work rolls 30, thereby moving the work rolls away from the strip.

During the automatic adjustment of work roll 30 position, the overall amount of work roll movement is monitored. More specifically, work roll adjusting means position is monitored. As a given amount of work roll adjusting means movement will result in a known amount of work roll 30 displacement, the position of the work roll adjusting means is monitored to determine the amount of work roll displacement. In the particular embodiment of the leveler 10 shown in FIGS. 1–7, if any of the adjusting wedge assemblies 130A–130I reach a position that would result in approximately a 50% or greater penetration of the upper work rolls 30 into the metal strip 50, the entry gap jack assembly 85 is signaled to cause a reduction of the entry gap 95. The reduction in the entry gap 95 generates an overall increase in the forces exerted on the metal strip 50 by work rolls 30, 35. Likewise, if it is determined that any of the adjusting wedge assemblies 130A–130I has reached a position that would equate to approximately 5% or more of negative bending of the upper work rolls 30, the entry gap jack assembly 85 is signaled to cause a reduction of the entry gap 95. Contrarily, if the adjusting wedge assembly that has experienced the least amount of penetration producing movement reaches a position that corresponds to a 10% or greater penetration of the upper work rolls 30 into the metal strip 50, the entry gap jack assembly 85 is signaled to cause an increase in the entry gap 95. The increase in the entry gap 95 causes a reduction in the amount of force exerted on the metal strip 50 by the work rolls 30, 35.

The microprocessor-based automatic shape control system continues to receive signals from the shape sensor 140, and to feed the signals back to the leveler control devices 85, 90, 130A–130I, in order to adjust the bending of the upper work rolls 30 and/or the leveler's entry and/or exit gaps 85, 90. The greater the shape sensor 140 readings differ from zero, the more substantial will be the movements of the work roll adjusting means and/or entry gap jack assembly 85. As the stresses in the metal strip 50 converge toward zero as a result of adjustments to the leveler 10, further adjustments will generally be more minute (assuming the stresses throughout the coil of metal strip remain substantially similar).

Figure 8:
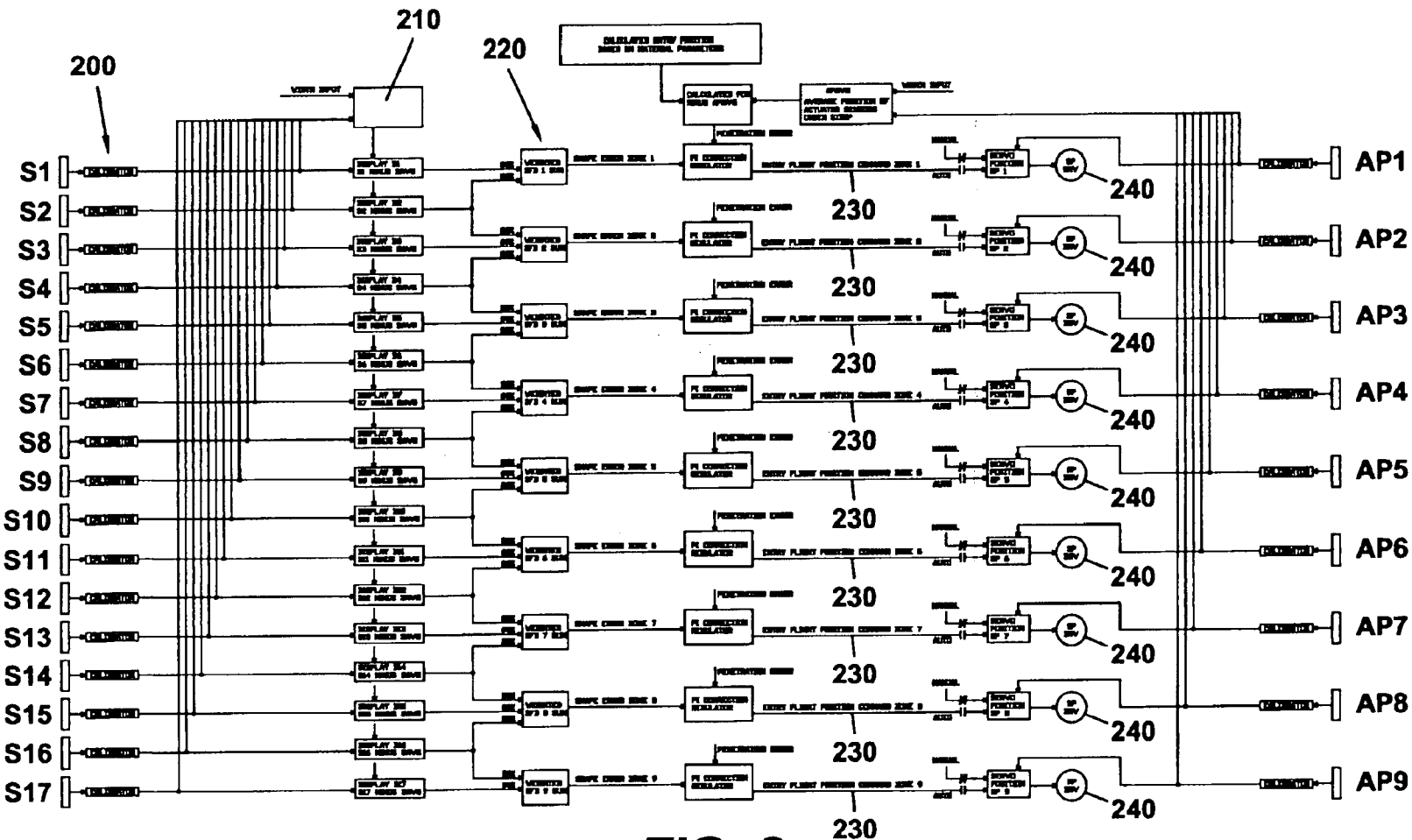
FIG. 8 is a flowchart illustrating a control algorithm employed to control a leveler with automatic shape control of the present invention.

A better understanding of the operation of the automatic shape control of the present invention can be had by reference to FIG. 8 and a reading of the following description. Referring to FIG. 8, a block diagram illustrating the steps of effecting automatic shape control in an exemplary embodiment of a leveler of the present invention can be observed. The particular embodiment of a leveler controlled by the automatic shape control process of FIG. 8, employs a series of nine work roll adjusting devices to produce the work roll bending necessary to flatten a strip of metal. A shape sensor, such as the shape meter 145 or another suitable detector, is integrated with the leveler to measure the profile of the metal strip as it passes out the exit side thereof. In this particular embodiment of the present invention, the shape sensor is provided with 17 sensing segments S1–S17. A sensing segment is preferably aligned with each work roll adjusting device, and an additional sensing segment is located between adjacent work roll adjusting devices. Thus, the 17 sensing segments S1–S17 provide data for nine measurement zones Z1–Z9. Any number of sensing segments and sensing zones may be employed, however, such as, for example, the 26 sensing segments and nine sensing zones shown in FIGS. 7*a*–7*b*. While this particular sensor arrangement provides for a sensor resolution that is twice that of the adjustment resolution, additional sensing segments may be added to further increase the sensor resolution.

Preferably, each sensing segment S1–S17 has its own zero and gain calibration 200. The force detected by each sensing segment S1–S17 in contact with the strip is considered by the shape control algorithm, while any readings from sensing segments outside the width of the strip are ignored. The force measurements from each sensing segment S1–S17 are summed and divided by the number of sensing segments to obtain an average force reading 210, which is adopted as the baseline force measurement. Preferably, a reading of the force on each sensing segment S1–S17 is displayed for observation by an operator of the leveler. For example, the display may indicate the relationship of the force on each individual sensing segment S1–S17 to the baseline force measurement. These measurements may be indicated in a +/−fashion with respect to the baseline force measurement.

The force measurements from the individual sensing segments S1–S17 that make up a measurement zone are then examined to determine the shape error present in the strip. In this particular embodiment of the present invention, each measurement zone (except for the end zones) is made up of one sensing segment that is aligned with a work roll bending device, and a sensor adjacent to either side thereof. Thus, each measurement zone receives force data from three sensing segments (each end zone has only one adjacent sensing segment and, therefore, receives data from only two sensing segments). The sensing segment signal weight is preferably tunable, so that more or less importance can be assigned to the measurement data emanating from each of the three sensing segments. For example, in this particular embodiment of the present invention, the shape error summation 220 for each measurement zone is accomplished with a weight of 60% assigned to the measurement data coming from the sensing segment aligned with the work roll adjusting device, and a weight of 20% assigned to the measurement data coming from the adjacent sensing segments (each end measurement zone utilizes a 80:20 ratio). The difference between the summed value for each measurement zone and the baseline force measurement, indicates the shape error of the strip in the area of the respective measurement zone.

The calculated shape error is used by the control algorithm to adjust the position of the work roll bending devices. Sensors AP1–AP9 are provided at each work roll bending device to measure the position thereof with respect to the strip. The sensors preferably monitor both entry penetration and roll bending, and have both zero and gain calibration. Position data from each work roll bending device position sensor AP1–AP9 is received and summed to determine an average position of the work roll bending devices. This average work roll bending device position is then subtracted from the entry penetration calculated during initial setup of the leveler (see above), to obtain a penetration error. A summation of the penetration error and the shape error is then performed for each measurement zone. A proportional integral (PI) controller thereafter generates a position command 230 for each work roll bending device that is proportional to the summed error, and instructs an actuator (servo) 240 at each work roll bending device to move accordingly. Preferably, the PI controller is tuned to prevent hunting and overcorrection. Each servo 240 is preferably in electronic communication with its respective work roll bending device position sensor AP1–AP9 so that the position of each work roll bending device can be monitored and maintained according to the most recent command from the PI controller.

This automated shape control process is then repeated as the strip continues to pass through the leveler. The sampling rate of the sensors and the frequency of adjustment can vary. For example, the sampling rate and frequency of adjustment will typically be at least somewhat dependent on the speed of the metal strip material passing therethrough. Other factors may also influence the sampling rate and frequency of adjustment, such as, for example, the degree of shape error present in the strip.

Figure 9:
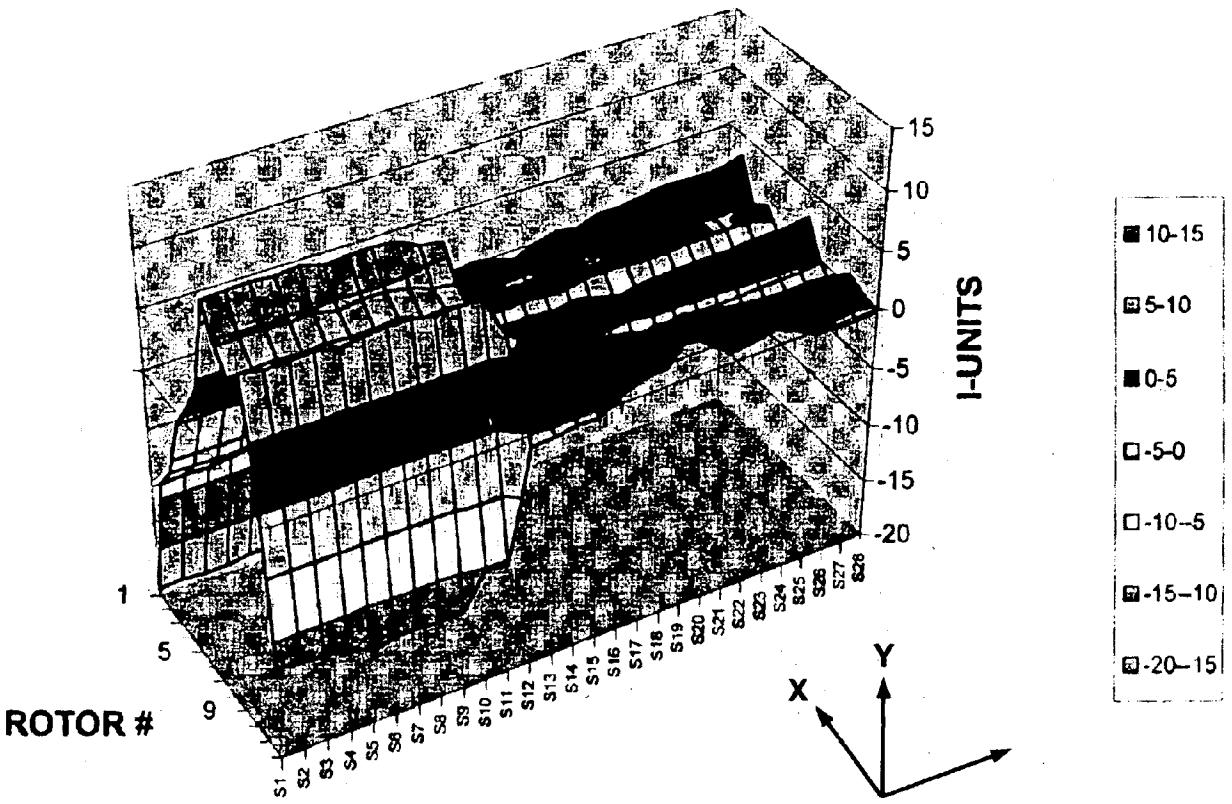
FIG. 9 is a graph showing the reduction of stresses and resulting flattening of a exemplary metal strip by a leveler with automatic shape control according to the present invention.

A scan can be seen in FIG. 9, the leveler with automatic shape control of the present invention can significantly improve the flatness of a strip of material. The graph of FIG. 9 represents a material strip, a portion of which has been untreated, and a portion of which has been acted upon by a leveler with automatic shape control of the present invention. As represented on the Z-axis of the graph, the left hand portion of the material strip shows the stresses present in and, thus, the waviness (in I-Units) of the material strip as it exists in coiled form. It can be seen that the waviness exists substantially across the width of the strip, which extends from rotor #1–rotor #9 (work rolls bending devices 1–9) of the leveler, as shown on the X-axis of the graph. Progression of the material strip through the leveler is represented by the Y-axis of the graph. As the material strip progresses through the leveler (as represented by a left to right movement along the Y-axis of the graph), it can be observed that there is a marked change in the waviness of the strip corresponding to the time at which the automatic shape control function of the leveler is initiated (at about S12). The effect of the automatic shape control system of the leveler is apparent, as the stresses and resulting waviness in the strip can be seen to be greatly reduced, and the flatness of the strip greatly improved after the automatic leveling process was initiated. As the strip continues to be subjected to the automatic shape control process, the flatness thereof may improve even further.

Figure 10A:
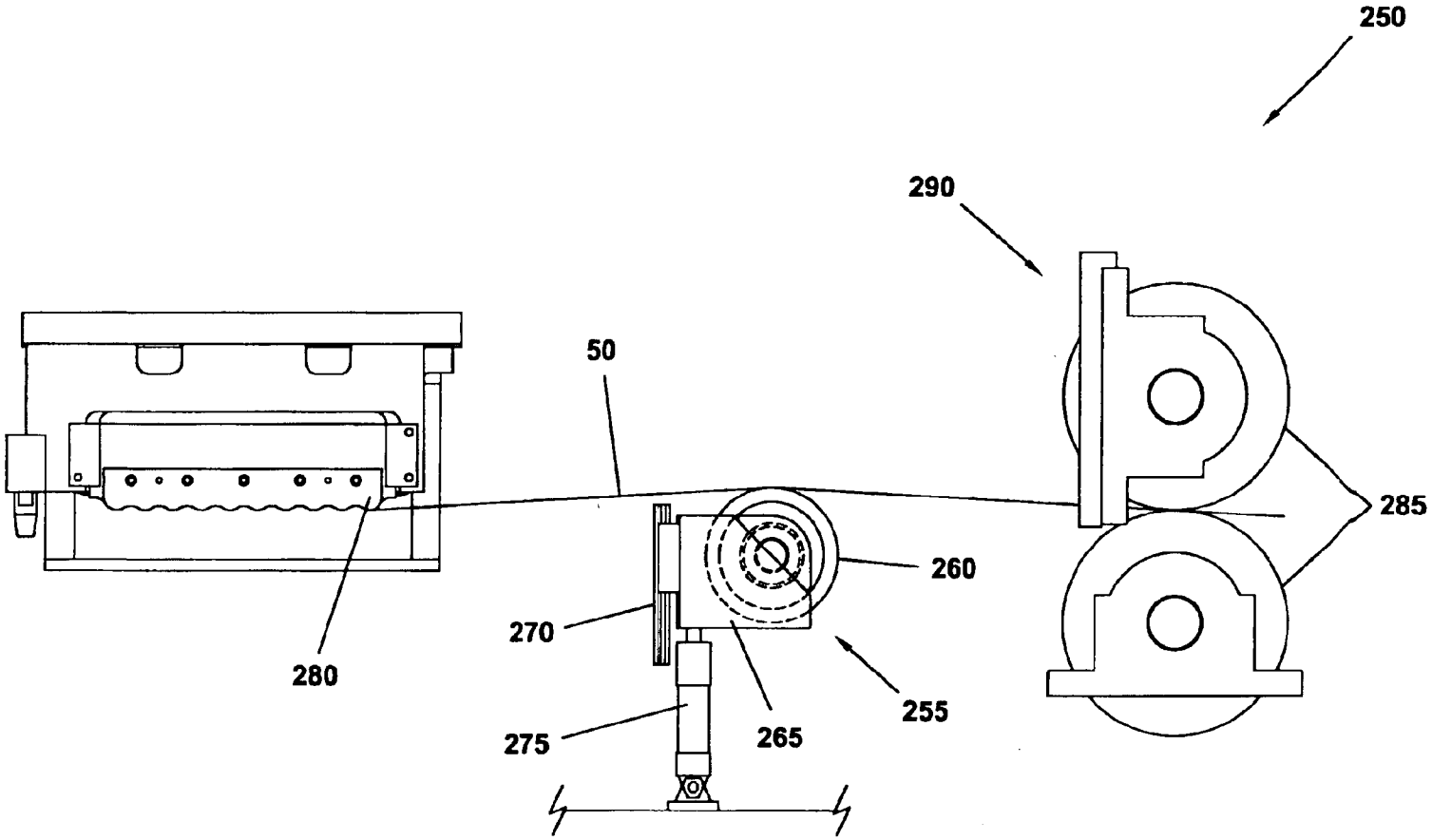
FIG. 10*a* is an enlarged, partial side elevational view illustrating an alternate embodiment of a shape sensor of the present invention, wherein a displacement-type shape sensor is used by the leveler with automatic shape control.
Figure 10B:
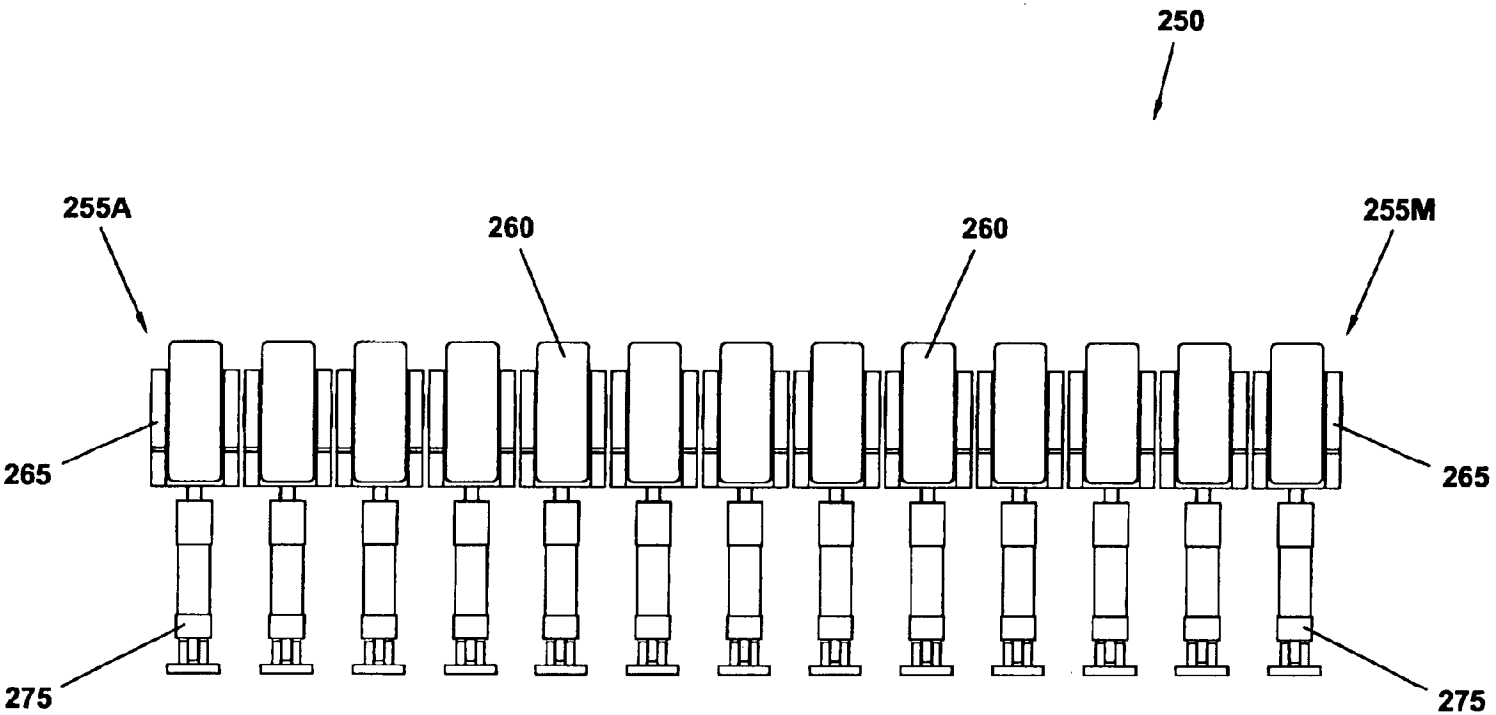
FIG. 10*b* is a front elevational view of the displacement-type shape sensor of FIG. 10*a;*
Figure 10C:
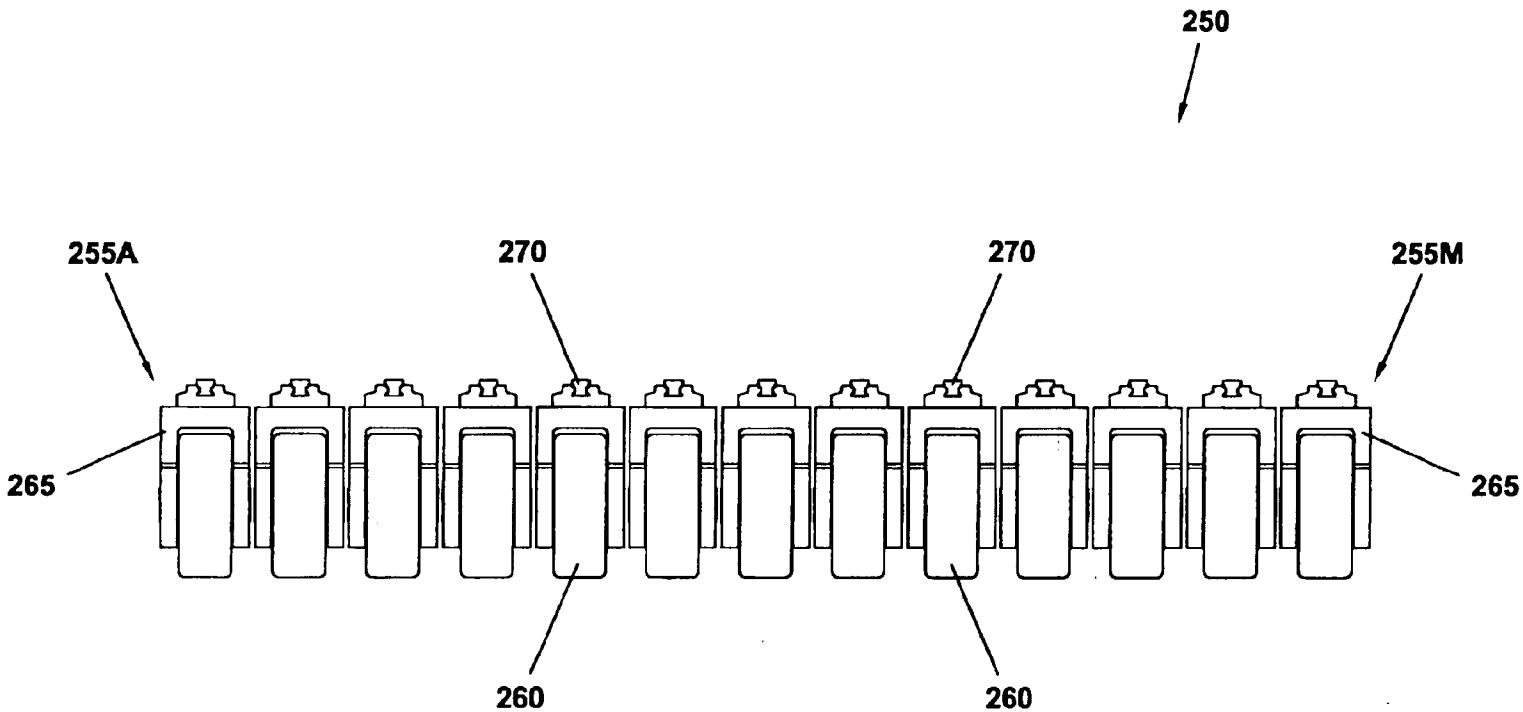
FIG. 10*c* is a top plan view of the displacement-type shape sensor of FIG. 10*a;*

An alternate embodiment of a shape sensor is shown in FIGS. 10*a*–10*c*. This particular shape sensor will be referred to as a displacement-type shape sensor 250, because it determines the shaper error in the metal strip by measuring the displacement of a plurality of individual displacement sensors 255A–255M. When employed by the leveler with automatic shape control 10 of the present invention, the displacement-type shape sensor 250 is preferably integral thereto, and situated at the exit of the leveler. However, it is anticipated that the displacement-type shape sensor 250 could also be used in a stand-alone fashion. As can be seen in FIGS. 10*b*–10*c*, the displacement sensors 255A–255M are preferably aligned, and arranged to traverse the width of the strip 50. The individual displacement sensors 255A–255M are comprised of free spinning precision roller bearings 260 attached by a bracket 265 to a linear guide 270. Each assembly of the roller bearing 260 and bracket 265 is connected to an air cylinder 275, which is provided to impart vertical movement thereto along the path of the linear guide 270. The quantity and spacing of the individual displacement sensors 255A–255M determines the overall resolution of the displacement-type shape sensor 250. For example, one embodiment of the displacement-type shape sensor 250 employs twice the number of displacement sensors 255A–255M as there are work roll bending devices in the leveler.

The operation of the displacement-type shape sensor 250 is substantially opposite that of the air-bearing shape meter 145 discussed above. The air-bearing shape meter 145 operates by detecting areas of tension that are located across the width of the strip 50. It is the protruding areas of tension in the passing strip 50 that apply a force to the associated sensing segments 155 of the shape meter 145, thereby allowing for measurement thereof. In contrast, the displacement-type shape sensor 250 detects loose areas across the width of the strip 50, which areas generally occur at a portion of the strip that is longer than adjacent portions thereof. For example, when an edge of the strip 50 is longer than its center, the strip may have a wavy edge. Similarly, when the center of the strip 50 is longer than its edges, the strip may have a center buckle.

Referring specifically to FIG. 10*a*, it may be observed that the displacement sensors 255A–255M are designed to be forced against the metal strip 50 as the strip passes by. It is preferred that the displacement sensors 255A–255M be located below the strip 50. A subjacent location of the displacement sensors 255A–255M provides for several advantages, including: a more simplistic threading of the strip 50 over the sensors; the negation of backlash in the assembly 250 because gravity is acting on the sensors in the same direction as the deflection forces imparted by the strip, which also allows the air cylinders 275 to operate without a counterbalance; and, the elimination of distortion in the strip that may be caused by a bowed exit work roll as the strip leaves the leveler. While it is preferred that the displacement sensors 255A–255M be located subjacent to the strip 50, it should also be understood that the sensors may also be mounted above the strip, and such is contemplated by the present invention.

The displacement sensors 255A–255M are preferably mounted to a rigid cross-member (not shown) or other suitable mounting structure, so that it can be ensured that any measured displacement of the displacement sensors is due to strip deflection, and not sensor mounting deflection. The air pressure supplied to each cylinder 270 should also be the same, to ensure that each displacement sensor 255A–255M is pressed against the strip 50 with equal force. As the vertical force of the sensors 255A–255M must be sufficient to adequately deflect the strip 50 while not imparting any shape defects thereto, the air pressure supplied to the air cylinders 270 is preferably also adjustable to allow for use of the displacement-type shape sensor 250 with a variety of materials of different elasticity.

In operation, the strip 50 must be placed under tension, such as by its placement between two defined-position straight rolls 280, 285 (see FIG. 10*a*). In this embodiment, the strip 50 is shown to be placed in tension between the exit work roll 280 of the leveler and the rolls 285 of a pull roll 290, but other means of applying tension to such a strip of material are known. The individual displacement sensors 255A–255M are then gently driven by the air cylinders 270 against the bottom of the strip 50 as it passes overhead. A high-precision linear measurement device (not shown) is provided on each displacement sensor 255A–255M. Each high-precision linear measurement device measures the displacement of its associated displacement sensor 255A–255M as it is pressed against the strip 50. Areas of less tension in the strip 50 (i.e., areas of the strip, such as a wavy edge or center buckle) will be deflected a greater distance by the displacement sensor(s) 255A–255M pressing against those areas. Areas of greater tension (shorter portions) in the strip 50 will be deflected a lesser amount by the displacement sensor(s) 255A–255M pressing against those areas. These deflections are measured by the displacement sensors 255A–255M, and may be used by the automatic shape control algorithm of the present invention to determine shape error in a similar manner as that described above with reference to FIG. 8.

Figure 11A:
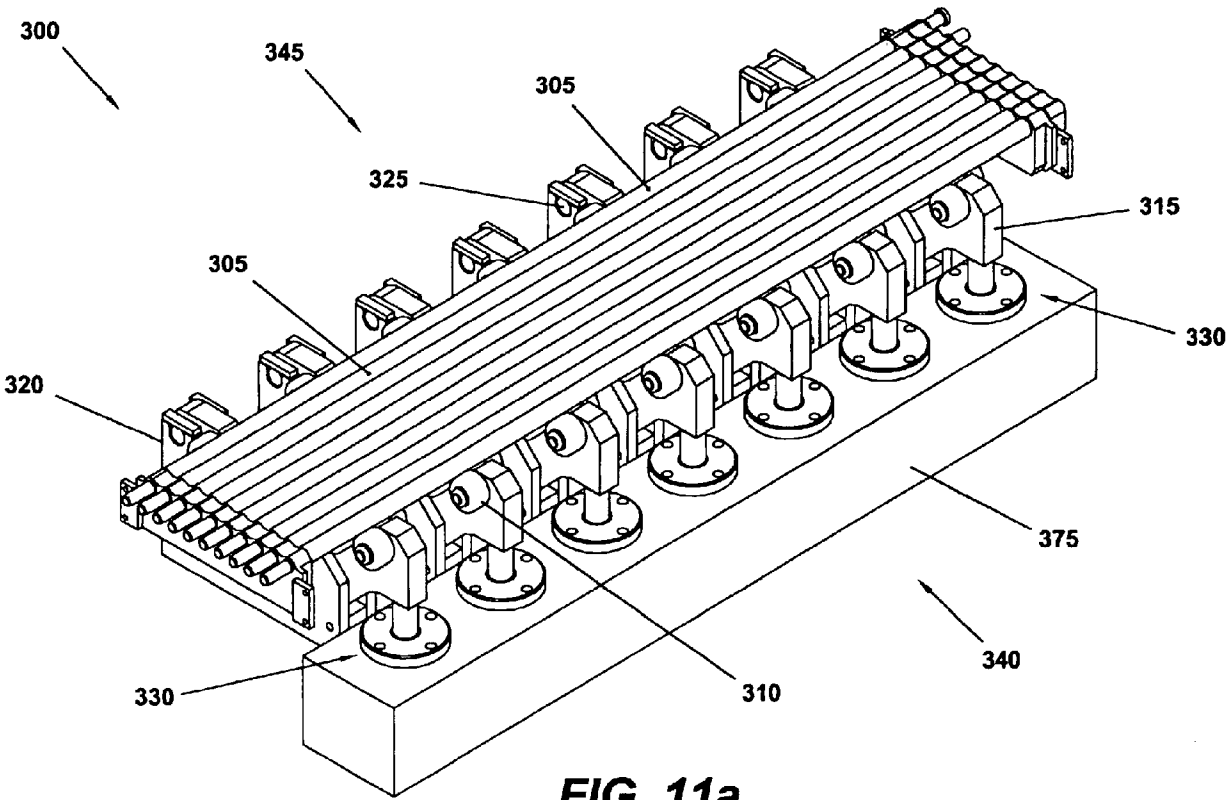
FIG. 11*a* is a perspective view of an alternate embodiment of a leveler cassette module, wherein the work rolls of the lower cassette are adapted to be bent through a pivoting action caused by a series of actuators integral to the lower cassette.
Figure 11B:
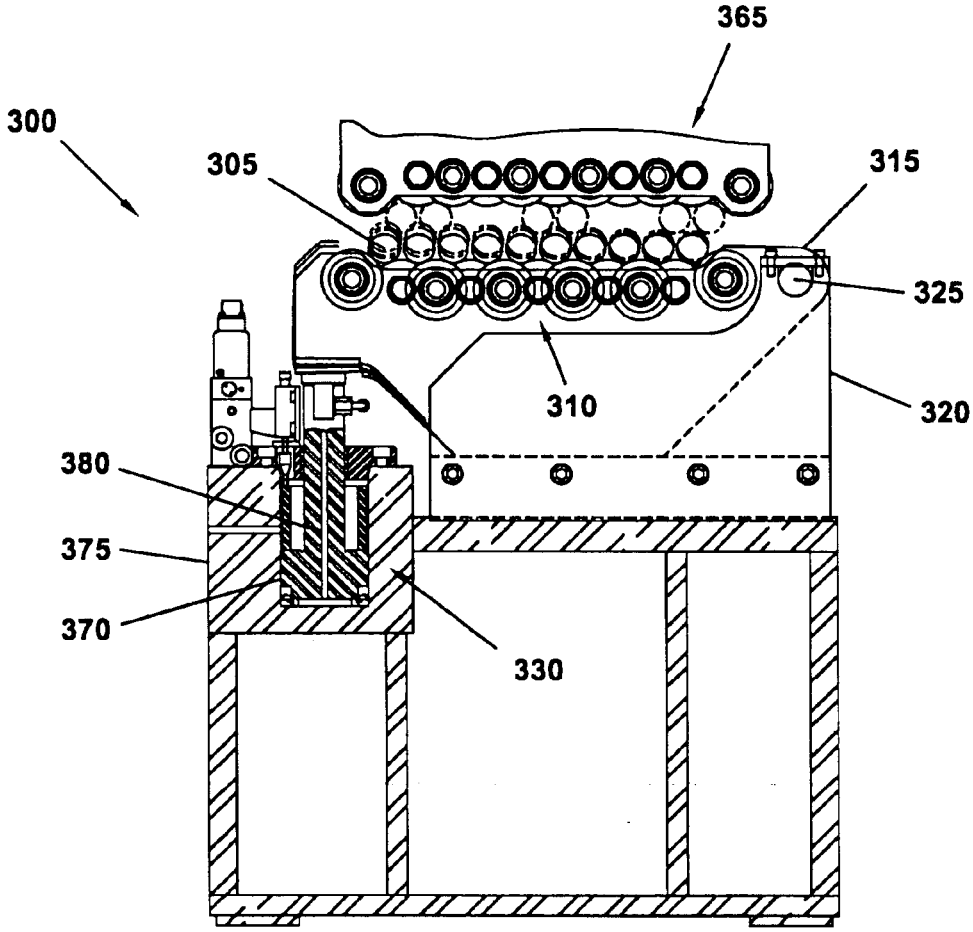
FIG. 11*b* is an enlarged right side elevational view, in partial cross-section, of the pivoting lower cassette module of FIG. 11*a;*
Figure 11C:
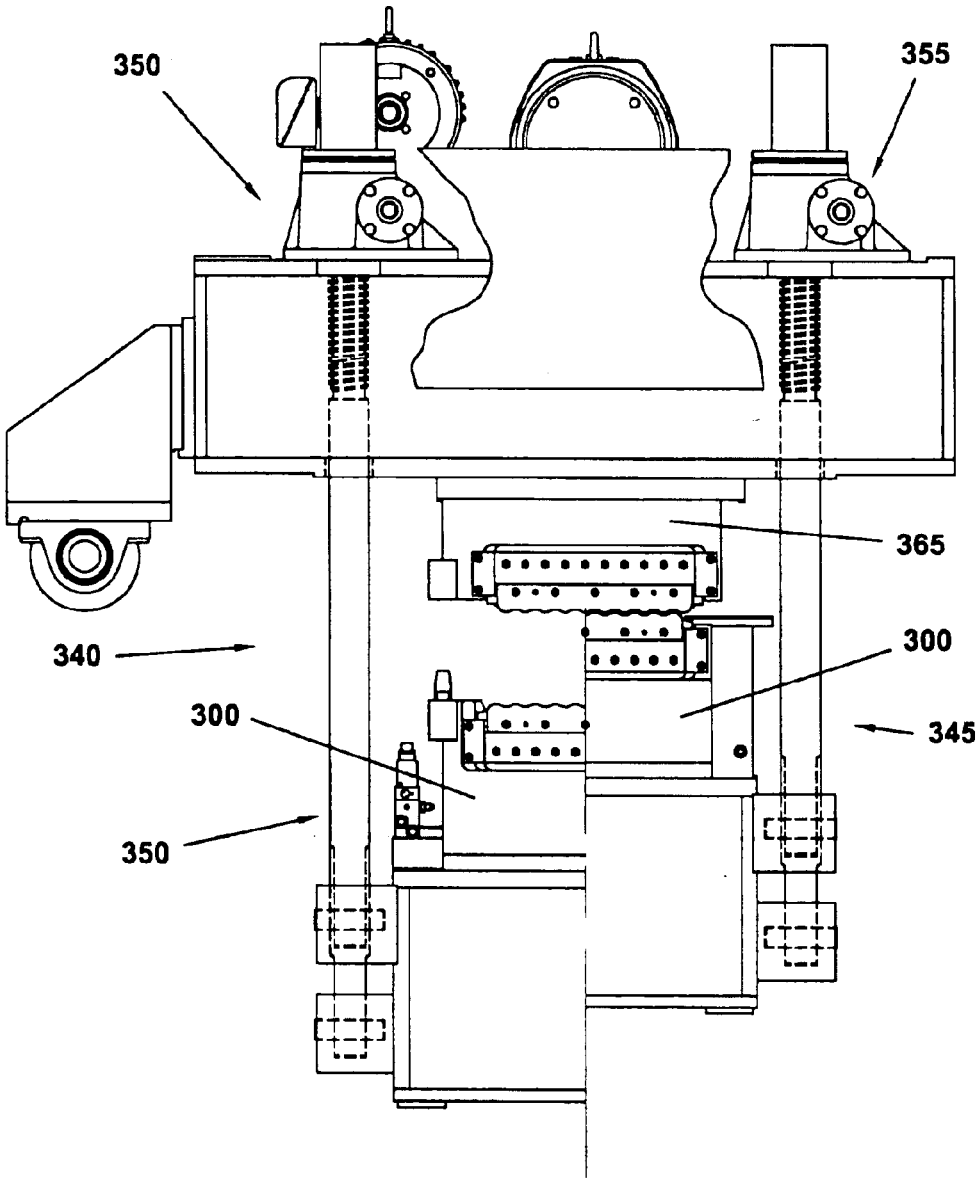
FIG. 11*c* is a partial right side elevational view showing the pivoting lower cassette module of FIG. 11*a* hangingly mounted within a leveler.

An alternate embodiment of a leveler lower cassette module 300 can be viewed in FIGS. 11*a*–11*c*. As can be seen by particular reference to FIGS. 11*a* and 11*b*, a series of work rolls 305 are disposed above a set of backup rollers 310, and are oriented to traverse the width of a strip of material as it passes through a leveler. Unlike the lower cassette assembly 75 described previously, the pivot-style lower cassette module 300 of FIGS. 11*a*–11*c* provides for bending of the work rolls 305. Thus, when the pivot-style lower cassette module 300 is used by a leveler, work roll bending will occur in the bottom set of work rolls, as opposed to the top set of work rolls.

Each set of backup rollers 310 is disposed on a roller mounting arm 315. Each roller mounting arm 315 is pivotally connected 325 at the exit side 345 of the cassette to a roller mounting arm pivot support 320, such as by the use of a pin. A work roll bending actuator 330 is provided to correspond to each roller mounting arm 315 present on the pivot-style lower cassette module 300. In this particular embodiment of the pivot-style lower cassette module 300, hydraulic work roll bending actuators 330 are employed, although it is contemplated that other types of actuators may also be successfully used. The work roll bending actuators 330 are integral to an entry 340 side portion of the pivot-style lower cassette module 300. When activated, the work roll bending actuators 330 exert an upward force on the entry end of their respective roller mounting arms 315. This upward force causes the roller mounting arm 315 to rotate about the pivotal connection 325 located in the roller mounting arm pivot support 320. The rotation of the roller mounting arm 315 about the pivotal connection 325 produces a resultant bending of the work rolls 305 at the location of the underlying roller mounting arm.

The pivoting action provided by the pivot-style lower cassette module 300 produces an aggressive bending of the work rolls 305 at the entry 340 thereto. The bending of the work rolls 305 progressively diminishes from the entry side 340 to the exit side 345 of the pivot-style lower cassette module 300, such that the work rolls at the exit side may be almost straight. This design feature reduces the amount of coil set in the strip if roll bending is adjusted during the process. The small amount of movement that may be incurred by the exit side work rolls 305 can be compensated for by adjusting the entire pivot-style lower cassette module 300 up or down (see FIG. 11*c*) to keep the exit work roll position substantially constant.

When hydraulic work roll bending actuators 330 are used in the pivot-style lower cassette module 300, it is preferred that the cylinders 370 therefor be bored integrally into a solid cross member 375 portion thereof. Hydraulic pistons 380 may then be placed directly into the cylinder bores 370. It is preferred that pressurized hydraulic fluid from a pressurized hydraulic source (not shown) be delivered to each piston 380 through a port in the side of the piston rod. This minimizes the amount cross member 375 port drilling, and also reduces the amount of hydraulic piping required. The flow of pressurized hydraulic fluid is then routed through the piston rod. The flow of pressurized hydraulic fluid is preferably regulated by a servo valve that may be controlled by the microprocessor of the automatic shape control system. Preferably, the hydraulic actuator valve used is also of a single acting/spring return design, to further reduce the amount of necessary hydraulic piping.

Although various methods of mounting the pivot-style lower cassette module 300 within a leveler may be employed, it is preferred that a hanging arrangement be used. Referring now to FIG. 11*c*, a hanging mounting of the pivot-style lower cassette module 300 can be observed. In this embodiment, the pivot-style lower cassette module 300 hangs from the jack assembly pairs 350, 355 of the leveler, which may be similar to the entry and exit jack assemblies 85, 90 of the leveler with automatic shape control 10. Hanging the pivot-style lower cassette module 300 from the jack assemblies 350, 355 eliminates any backlash in the adjustment mechanism of the leveler, as the backlash is acted on by gravity in the same direction as the separating forces generated during the metal strip flattening process. This leads to improved repeatability and accuracy. Additionally, because the separating forces between the top and bottom work roll cassettes are transmitted only through the jack assemblies 350, 355, which are in tension, deflection of the leveler frame under load is also reduced.

It is preferred that each of the jack assemblies comprising the jack assembly pairs 350, 355 be mechanically connected, such that activation thereof will produce a parallel lifting or lowering of the pivot-style lower cassette module 300. In this embodiment, all four jack assemblies are driven by a single electric motor 360 of preferably variable speed design, thereby forming a motor/jack screw lift system. In this embodiment, the motor/jack screw lift system is used to set the exit gap between the upper and lower cassettes 365, 300. The entry gap is reduced by using all of the hydraulic work roll bending actuators 330 to lift their respective roller mounting arms 315 by the same desired amount, thereby causing the work rolls 305 at the entry side 340 of the leveler to bend substantially uniformly upward. Similarly, the entry gap can be reduced by instructing the hydraulic work roll bending actuators 330 to lower their respective roller mounting arms 315.

The pivot-style lower cassette module 300 may be used in the leveler with automatic shape control 10. The pivot-style lower cassette module 300 can also be used in a leveler without automatic shape control. When used with a leveler having automatic shape control 10 according to the present invention, the shape sensor 140 is preferably designed to have measurement zones that are substantially aligned with the roller mounting arms 315 (i.e., aligned with the bending points of the work rolls). Shape error detection and correction may be accomplished substantially as described with respect to FIG. 8, above. The roller support arms 315 and hydraulic work roll bending actuators 330 may be provided in virtually any number to produce a desired adjustment resolution.

Figure 12A:
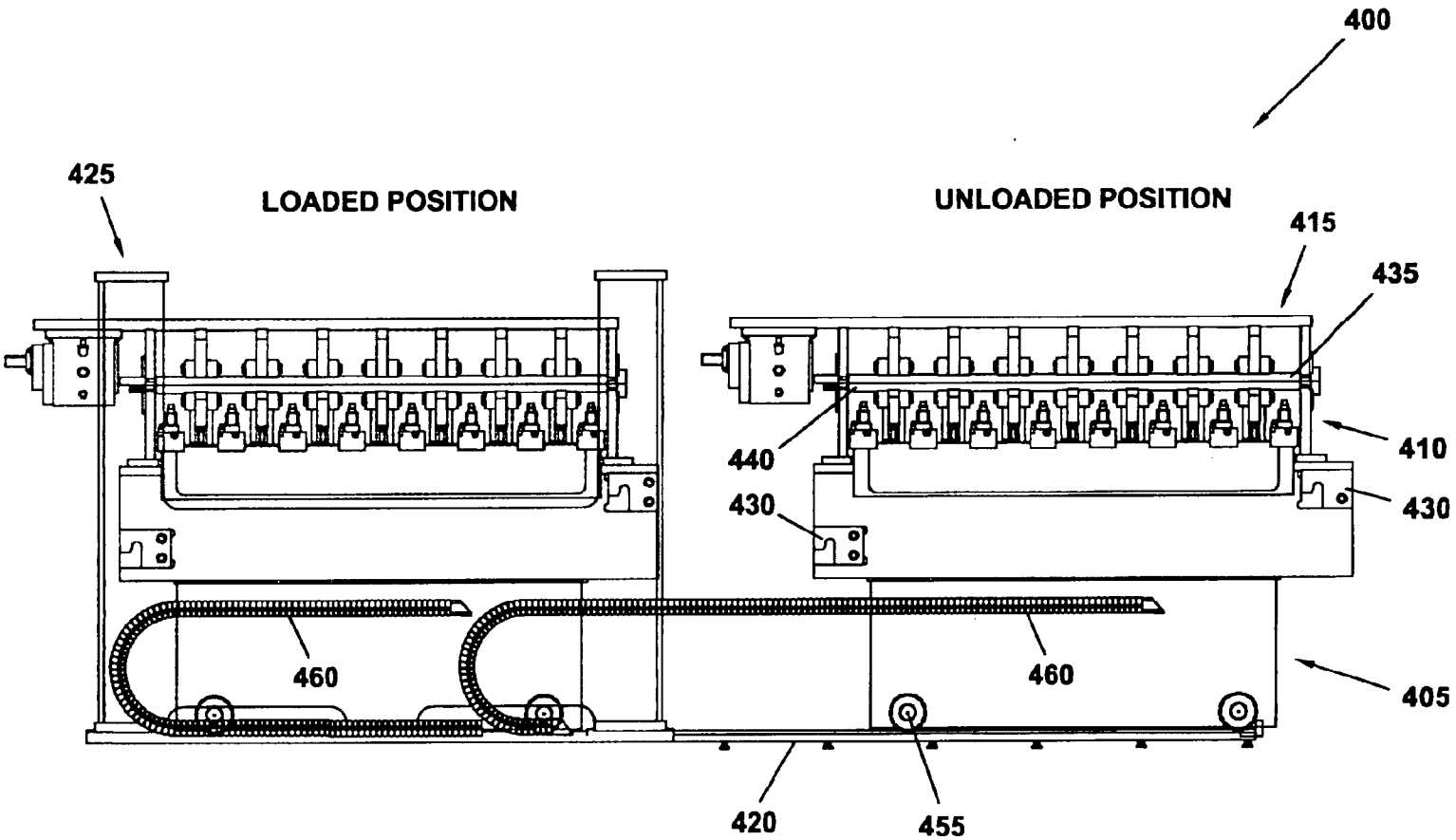
FIG. 12*a* is a front elevational view of one embodiment of a leveler cassette quick removal system.
Figure 12B:
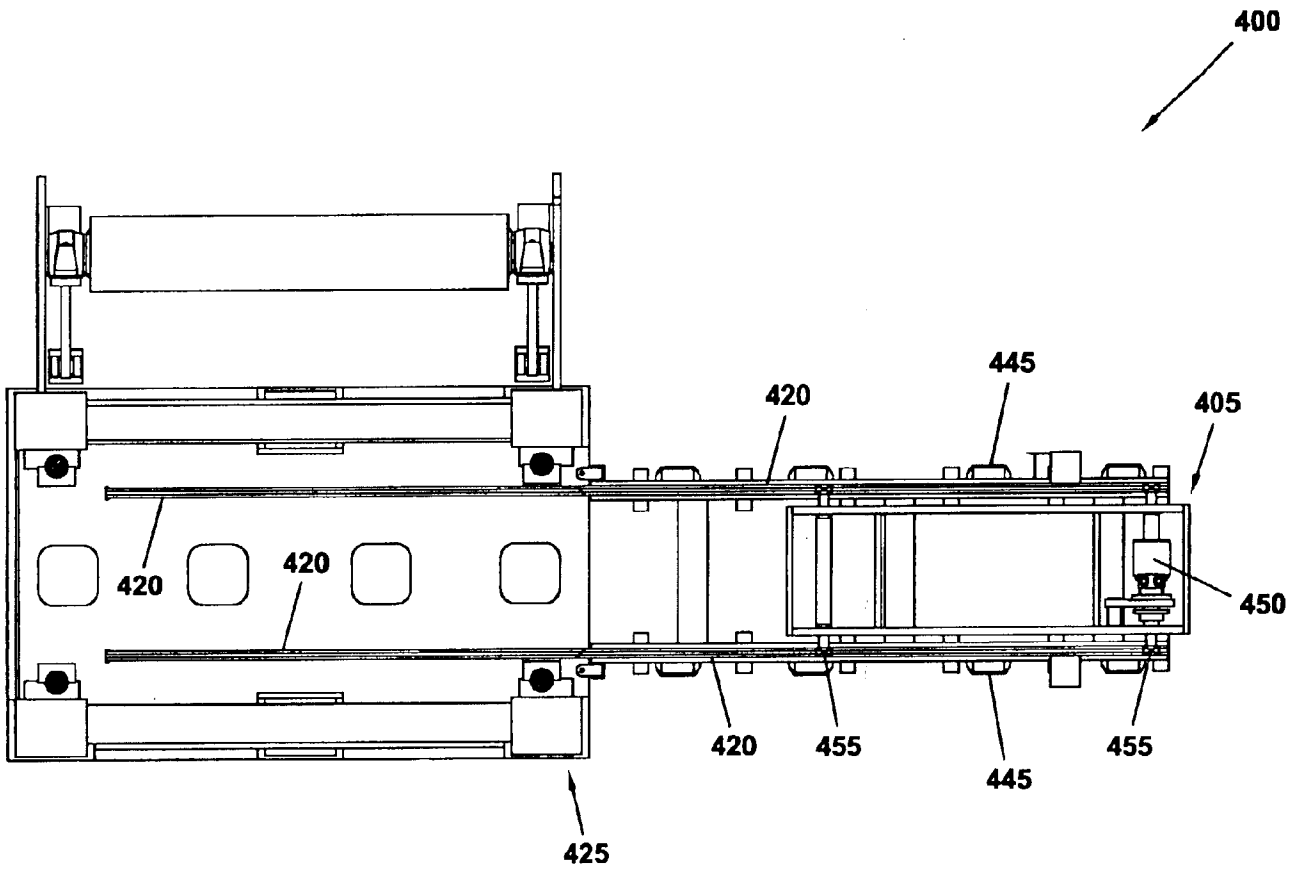
FIG. 12*b* is a top plan view of the leveler cassette quick removal system of FIG. 12*a;*

An embodiment of a leveler cassette quick change system 400 is illustrated in FIGS. 12*a* and 12*b*. A loaded and unloaded cassette position can be observed in FIG. 12*a*. A movable cart 405 is provided to remove all, or a portion, of the leveler cassettes 410, 415. The cart is adapted to traverse along a set of guide rails 420 that extend some distance out the side of a lower portion of the leveler frame 425. In the loaded position, the cassette(s) 410, 415 are properly located within the work envelope of the leveler frame 425. In the unloaded position, the cassette(s) 410, 415 are preferably removed to a distance that will prohibit interference with leveler operations.

The leveler cassette quick change system 400 is designed to work in conjunction with a lower cassette 410 that is mounted to the leveler frame 425 in a hanging arrangement. Such a cassette mounting method is illustrated in FIG. 11*c*, and is discussed in detail above. Briefly, the lower cassette 410 is supported by the corner jack assemblies of the leveler, with a jack screw portion of each passing through a respective portion of the lower cassette. Thus, the cart 405 may be permanently affixed to, and reside below the lower cassette 410.

The leveler cassette quick change system 400 facilitates the installation or removal of the leveler cassette(s) 410, 415, or portions thereof. For example, to effect unloading of the cassette(s) 410, 415, or a portion thereof, the lower cassette 410 and cart 405 are simply lowered until the cart is in contact with the guide rails 420. Further lowering of the jack assemblies allows for their disengagement from the lower cassette 410, and for subsequent removal of the lower cassette and cart 405 from the leveler, as described in more detail below.

There are effectively two levels of cassette removal. In the first, and most common level, only the lower cassette 410 is removed. To remove the lower cassette 410, the jack assemblies are fully lowered, which allows the bottom portion of each jack screw to disengage from mounting hooks 430 located on the lower cassette 410. The jack screws are typically mated to the open mounting hooks 430 with only a thru-pin, therefore, no bolts or drive connections will generally have to be removed. With the jack assemblies in a fully lowered position, the lower cassette 410 and attached cart 405 will rest on the guide rails 420. The cart 405 and lower cassette 410 can then be rolled out of the leveler along the guide rails 420. It is also possible to remove the upper cassette 415 and lower cassette 410 as a set (as shown in FIG. 12*a*). This is accomplished by releasing the upper cassette 415 from the upper bolster while the upper and lower cassettes are in substantial contact within the leveler. The complete cassette 410, 415 can then be removed from the leveler as described above.

The cart 405 may be maneuvered into and out of the work envelope within the leveler frame 425 by hand, such as by use of the handles 445 provided thereon. More preferably, however, the cart 405 is powered by a motor 450 that drives at least one of the cart's wheels along the guide rails 420. The powered cart 405 may be operated manually, such as by activating a switch, or may move automatically between the loading and unloading positions. When the cart 405 employs a motor 450, a flexible cable guide 460 is preferably provided to properly move the associated cables and other connections therefor along with the cart.

The leveler cassette quick change system 400 of the present invention provides for the efficient removal of the cassette(s) 410, 415, or portions thereof. This makes maintenance and repair of the work rolls 435, 440 and other cassette components much easier. In addition, the leveler cassette quick change system 400 allows for rapid cassette changing in the event of damage, thereby minimizing downtime of the leveler.

Figure 13A:
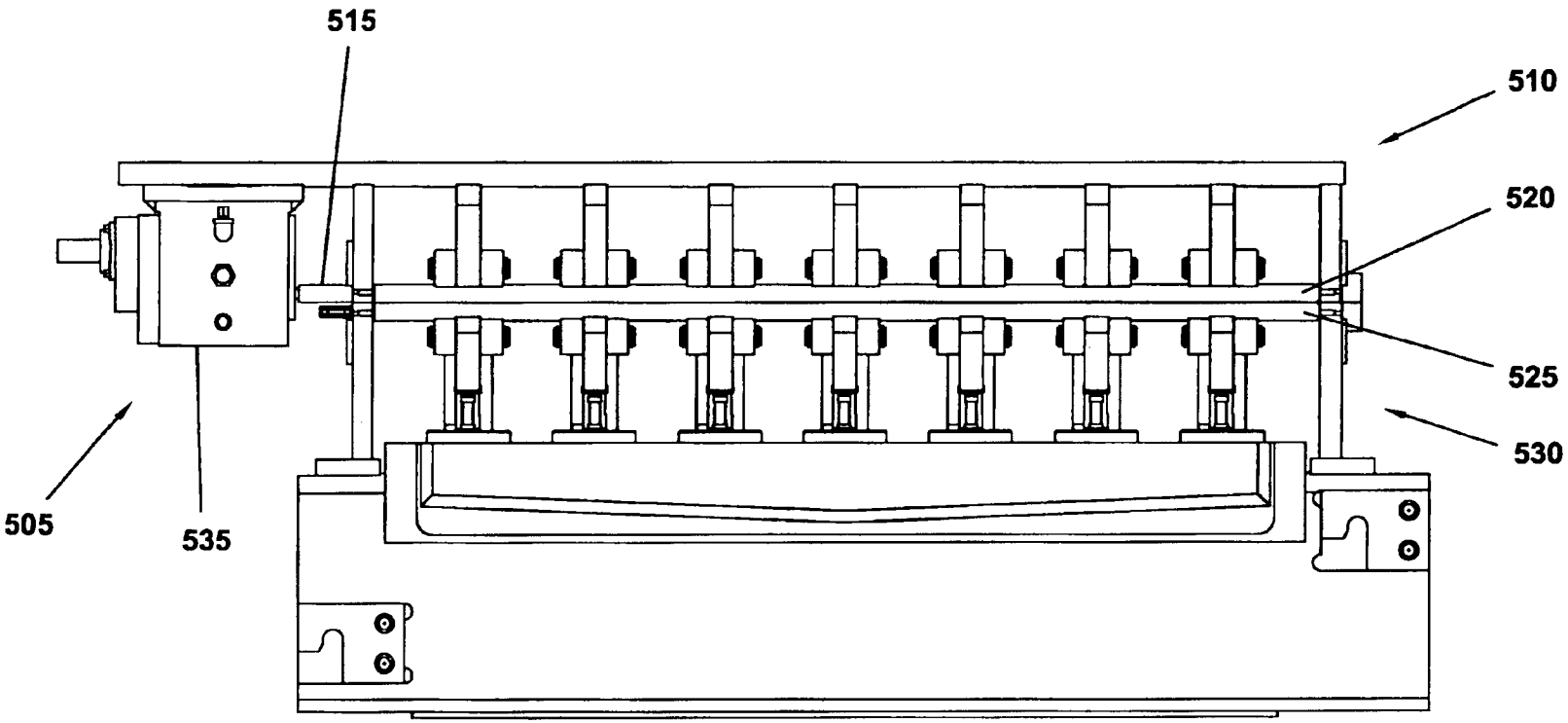
FIG. 13*a* is a front elevational view depicting a pinion gear box portion of one embodiment of a leveler drive system according to the present invention attached to a leveler upper work roll cassette.
Figure 13B:
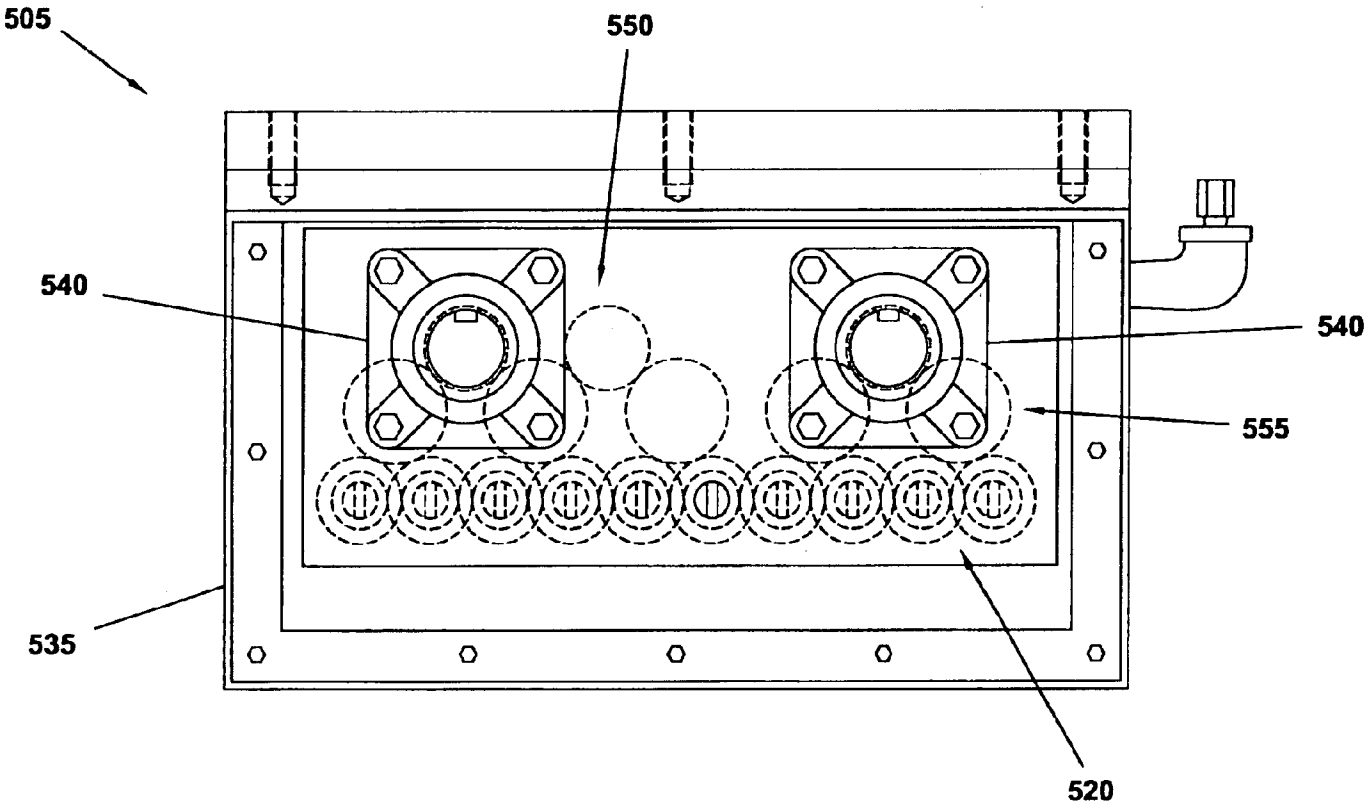
FIG. 13*b* is an enlarged side view of the pinion gear box of FIG. 13*a*.
Figure 13C:
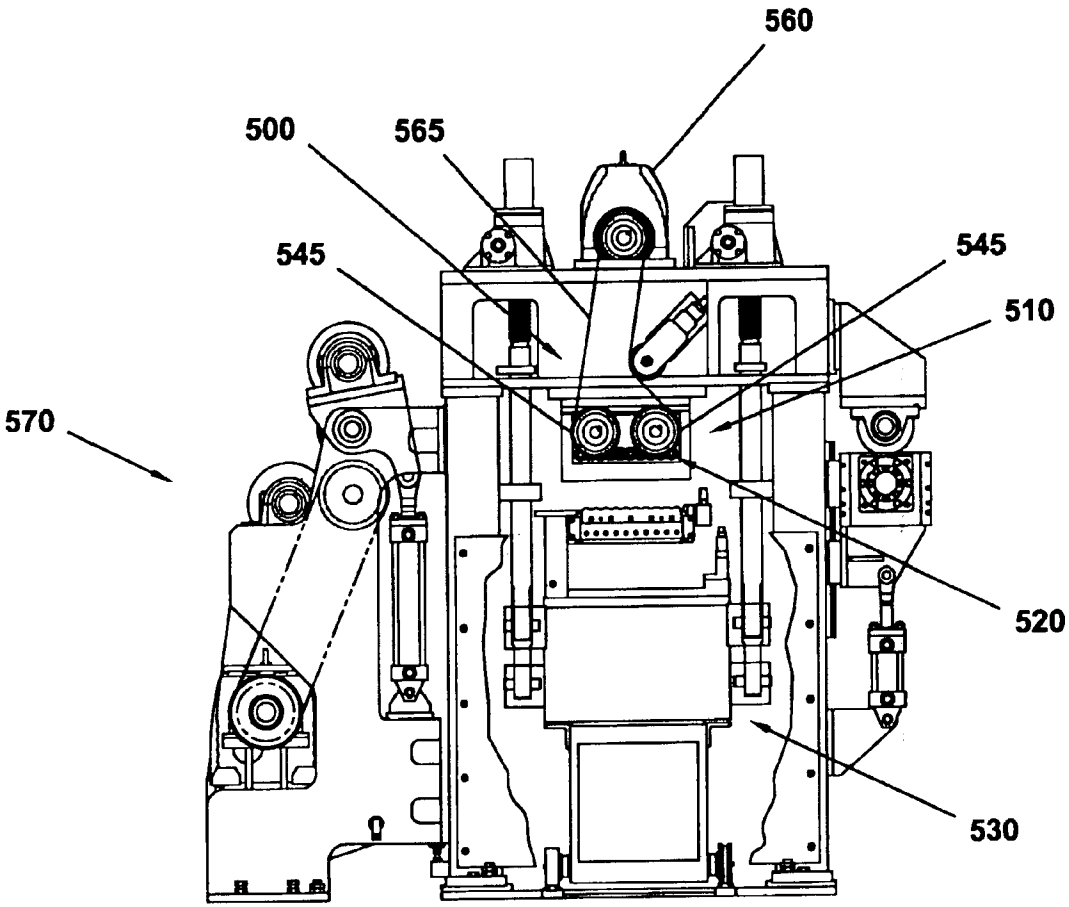
FIG. 13*c* is a side elevational view of the leveler drive system attached to a multiroll leveler.

An alternate embodiment of a leveler drive system 500 is depicted in FIGS. 13*a*–13*c*. The leveler drive system 500 may be used on the leveler with automatic shape control 10 of the present invention, or may be used on a leveler without automatic shape control. This leveler drive system 500 is especially well suited to use in a leveling process having an additional process loop after the leveling step, such as, for example, in a cut-to-length line. In a typical leveling process, the flattened strip leaving the leveler is rewound on a re-coiler or similar device, which also acts to maintain tension on the strip as it leaves the leveler. This tension is important when a shape sensor, such as the previously described shape meter 145 is utilized to measure shape error, because the sensing segments 155 thereof require tension to operate. However, when an additional process loop is located after the leveler, the leveler itself must generally be driven to feed the strip to the next process. In such a process, the strip is in a free state as it leaves the leveler, and there is no tension present therein.

The traditional drive system for driving such a leveler has caused many problems. This type of drive system typically employs a multi-output pinion gearbox. All the work rolls are then connected to the gearbox via drive shafts having universal joints. It is commonly these universal joints that require the most service in a known driven leveler.

The leveler drive system 500 of the present invention eliminates the troublesome universal joints that are typically used in a driven leveler. As can be seen by reference to FIG. 13*a*, the leveler drive system 500 of the present invention locates a pinion gear box 505 directly on the upper leveler work roll cassette 510. The pinion gear box 505 is adapted to drive only the straight rolls of the upper work roll cassette 510. The pinion output shafts 515 are designed to have the same center distance as the upper work rolls 520, and are preferably splined to facilitate roll removal.

Because only the upper work rolls 520 are coupled to the pinion gear box 505 in this embodiment of the leveler drive system 500, the lower work rolls 525 located in the lower cassette 530 will be free spinning (i.e., non-driven). When the leveler drive system 500 is used as described herein, it is also the lower work rolls 525 that provide the bending necessary to flatten the strip of material passing through the leveler. The lower work rolls 525 may be bent using known designs and work roll bending actuators. However, the design of the leveler drive system 500 makes it particularly well-suited for use in a leveler employing the pivot-style lower cassette module 300 described above.

Referring now to FIG. 13*b*, an enlarged side view of the pinion gear box 505 can be seen. The pinion gear box 505 has an enclosure 535 for housing the internal components thereof, and is adapted for mounting to the upper cassette 510. A pair of bearings 540 are provided on the enclosure 535 for receiving the input shafts of a corresponding pair of pulleys 545 (see FIG. 13*c*). Each input shaft of the pulleys 545 is coupled to a corresponding gear train 550, 555. The teeth of the gear trains 550, 555 mesh with the splines provided on the upper work rolls 520. Thus, when the pulleys 545 are rotated, a corresponding driven rotation of the upper work rolls 520 will also occur. Each gear train 550, 555 may drive an equal number of upper work rolls 520. However, in the embodiment shown, the gear train 550 nearer the entry side of the upper cassette 510 is designed to drive a greater number of upper work rolls 520 than is the gear train 555 nearer the exit side of the upper cassette. This design allows more driving power to be delivered to the upper work rolls 520 nearer the entry side of the leveler. This has been found to be advantageous when the leveler imparts more bending force to the lower work rolls 525 that are nearer the entry side thereof, than to the lower work rolls nearer the exit side thereof. This may be the case, for example, when the leveler utilizes the pivot-style lower cassette 300 described previously.

The pinion gear box 505 may be driven by various means, such as by an electric motor 560 (see FIG. 13*c*). In this particular embodiment, the electric motor 560 is located on top of the leveler frame, and is connected to by a belt 565 to the pulleys 545 that are coupled to the gear trains 550, 555 of the pinion gear box 505. Operation of the electric motor 560 then drives the upper work rolls 520.

Preferably, the leveler drive system 500 of the present invention also employs an adjustable pull-roll 570 that is located at the exit side of the leveler. The pull-roll 570 may be a stand alone design, but preferably, the pull-roll is attached to the leveler frame. The pull-roll 570 imparts additional tension to the strip material. This can be advantageous for several reasons. For example, it has been found that increasing the tension on the strip material will cause the material to better conform to the radius of the work rolls, which operates to shift the neutral axis of the material and to cause an increase in yield percentage thereof. Additionally, when performing the flattening operation on very light gages of material, there may be insufficient contact force to acceptably propel the strip of material through the leveler. Rather, the minimal separating forces that are generated may instead result in the work rolls simply spinning on the material. The pull-roll 570 can help to eliminate these problems by maintaining the strip in sufficient tension as it passes through the leveler. The pull-roll 570 also assists in providing the strip to the next process loop.

The leveler drive system 500 of the present invention can be seen to be an advancement over known leveler driving systems. The leveler drive system 500 of the present invention eliminates the need for troublesome universal joints that are typically used in a driven leveler. Use of the leveler drive system 500 of the present invention also allows for the lower work rolls of a leveler to be non-driven, thereby permitting the lower work rolls to be bent in order to apply the forces necessary to flatten the strip.

While certain embodiments of the present invention are described in detail above, the scope of the invention is not to be considered limited by such disclosure, and modifications are possible without departing from the spirit of the invention as evidenced by the following claims:

What is claimed is:

1. A displacement-type shape sensor for detecting the flatness of a moving strip of material, said sensor comprising:

a roller bearing assembly comprising a roller bearing supported within a roller bearing mount;

a guide for restricting movement of said roller bearing assembly along a desired path;

a rigid mounting member for receiving said guide and locating said roller bearing assembly either below or above said moving strip of material;

an actuator for displacing said roller bearing assembly along said guide such that said roller bearing contacts said moving strip of material; and a sensor for detecting an amount of linear movement of said roller bearing assembly;

wherein the combination of said guide and said rigid mounting member prevents said moving strip of material from causing a tangential deflection of said roller bearing assemby.

2. The displacement-type shape sensor of claim 1, wherein said roller bearing is a precision roller bearing.

3. The displacement-type shape sensor of claim 1, wherein said guide consists essentially of a linear guide rail having a guide block to which said roller bearing mount is affixed.

4. The displacement-type shape sensor of claim 3, wherein said guide directs movement of said roller bearing assembly along a path that is substantially perpendicular to a surface of said moving strip of material.

5. The displacement-type shape sensor of claim 1, wherein said roller bearing is oriented to rotate in a direction of travel of said moving strip of material.

6. The displacement-type shape sensor of claim 1, wherein said mounting member is adapted to receive a plurality of said roller bearing assemblies.

7. The displacement-type shape sensor of claim 1, wherein said mounting member is located below said moving strip of material, so that said roller bearing assembly is displaced against a bottom surface of said moving strip of material.

8. The displacement-type shape sensor of claim 1, wherein said mounting member is located above said moving strip of material, so that said roller bearing assembly is displaced against a top surface of said moving strip of material.

9. The displacement-type shape sensor of claim 1, wherein said actuator is a pneumatic cylinder.

10. The displacement-type shape sensor of claim 1, wherein said actuator is a hydraulic cylinder.

11. The displacement-type shape sensor of claim 1, wherein said actuator is a hydro-pneumatic cylinder.

12. The displacement-type shape sensor of claim 1, wherein said actuator is an electric motor and drive assembly.

13. The displacement-type shape sensor of claim 1, wherein a signal from said sensor for detecting an amount of linear movement of said roller bearing assembly is output to an automatic shape control system of a leveler acting on said moving strip of material.

14. A flatness detection system for determining the flatness of a moving strip of material, said system comprising:

a plurality of displacement-type shape sensors disposed substantially across a width of said moving strip of material, each displacement-type shape sensor further comprising:

(a) a roller bearing assembly comprising a roller bearing supported within a roller bearing mount;

(b) a guide for restricting movement of said roller bearing assembly to a linear path that is substantially normal to a face of said strip of material;

(c) an actuator for displacing said roller bearing assembly along said guide such that said roller bearing contacts said moving strip of material; and (d) a linear displacement sensor for measuring an amount of linear movement of said roller bearing assembly along said guide;

a rigid mounting member for receiving said guides and thereby locating said displacement-type shape sensors either below or above said strip of material; and a means of displacing said roller bearings against said moving strip of material to cause a deflection thereof;

wherein after displacement of said roller bearings against said moving strip of material, an output signal from each said linear displacement sensor indicates the flatness of said strip of material in the area of its corresponding roller bearing; and wherein the combination of said guides and said rigid mounting member prevents said moving strip of material from causing a tangential deflection of said roller bearing assemblies and a corresponding error in said flatness indication signal.

15. The flatness detection system of claim 14, wherein said roller bearing is a precision roller bearing.

16. The flatness detection system of claim 14, wherein said guide consists essentially of a linear guide rail having a guide block to which said roller bearing mount is affixed.

17. The flatness detection system of claim 14, wherein said roller bearing is oriented to rotate in a direction of travel of said moving strip of material.

18. The flatness detection system of claim 14, wherein said mounting member is located below said moving strip of material, so that said roller bearing assembly is displaced against a bottom surface of said moving strip of material.

19. The flatness detection system of claim 14, wherein said mounting member is located above said moving strip of material, so that said roller bearing assembly is displaced against a top surface of said moving strip of material.

20. The flatness detection system of claim 14, wherein said actuator is a pneumatic cylinder.

21. The flatness detection system of claim 14, wherein said actuator is a hydraulic cylinder.

22. The flatness detection system of claim 14, wherein said actuator is a hydro-pneumatic cylinder.

23. The flatness detection system of claim 14, wherein said actuator is an electric motor and drive assembly.

24. The flatness detection system of claim 14, wherein said output signal from each said linear displacement sensor is sent to an automatic shape control system of a leveler to which said flatness detection system is coupled.

25. The flatness detection system of claim 24, wherein said automatic shape control system calculates an average shape error for said strip of material, and compares measurements from individual displacement-type shape sensors thereto.

26. The flatness detection system of claim 25, wherein measurements from said linear displacement sensors of said displacement-type shape sensors are output as an amount greater than or less than said average shape error.

27. The flatness detection system of claim 25, wherein the weight of the measurement associated with each individual displacement-type shape sensor is tunable, such that varying importance can be attached thereto by a control algorithm of said automatic shape control system.

28. The flatness detection system of claim 26, wherein said measurements associated with said linear displacement sensors of said displacement-type shape sensors are displayed for viewing by an operator.

29. The flatness detection system of claim 14, wherein at least one individual displacement-type shape sensor is substantially aligned with each individual means for bending one or more work rolls of a leveler to which said flatness detection system is coupled.

30. The flatness detection system of claim 29, further comprising at least one additional displacement-type shape sensor adjacent to each individual displacement-type shape sensor that is aligned with each of said individual means for bending said one or more work rolls.

31. The flatness detection system of claim 14, wherein there are about twice the number of displacement-type shape sensors as there are work roll bending devices in a leveler to which the flatness detection system is coupled.

32. The flatness detection system of claim 14, wherein said plurality of displacement-type shape sensors are automatically displaced against said moving strip of material.

33. The flatness detection system of claim 32, wherein said automatic displacement of said plurality of displacement-type shape sensors against said moving strip of material is controlled by an automatic shape control system of a leveler to which said flatness detection system is coupled.

34. The flatness detection system of claim 14, wherein the force exerted by said means of displacing said roller bearings against said moving strip of material is controlled.

35. The flatness detection system of claim 34, wherein said force is applied substantially equally to each of said plurality of displacement-type shape sensors.

36. The flatness detection system of claim 35, wherein each displacement-type shape sensor is connected to an individual means of displacing said roller bearings against said moving strip of material.

37. The flatness detection system of claim 35, wherein each displacement-type shape sensor is connected to a common means of displacing said roller bearings against said moving strip of material.

38. A method of determining the flatness of a moving strip of material, said method comprising:

providing a plurality of displacement-type shape sensors that are disposed substantially across a width of said moving strip of material, each displacement-type shape sensor comprising:

(a) a roller bearing assembly comprising a roller bearing supported within a roller bearing mount;

(b) a guide for restricting movement of said roller bearing assembly to a desired path;

(c) an actuator for displacing said roller bearing assembly along said guide such that said roller bearing contacts said moving strip of material; and (d) a linear displacement sensor for measuring an amount of linear movement of said roller bearing assembly;

providing a rigid mounting member for receiving said guides and thereby locating said displacement-type shape sensors either below or above said moving strip of material;

causing said actuator to displace said roller bearings against said moving strip of material as said moving strip of material passes said displacement-type shape sensors; and determining the flatness of said moving strip of material by using each of said linear displacement sensors to measure the amount of linear movement of each respective roller bearing assembly as its associated roller bearing is displaced against said moving strip of material;

wherein the combination of said guides and said rigid mounting member prevents said moving strip of material from causing a tangential deflection of said roller bearing assemblies and a corresponding error in said determined flatness of said moving strip of material.

39. The method of claim 38, further comprising placing said moving strip of material in tension prior to displacement of said roller bearings thereagainst.

40. The method of claim 38, further comprising a means for ensuring that the force exerted by said actuator is applied substantially equally to each of said plurality of displacement-type shape sensors.

41. The method of claim 38, further comprising controlling and/or monitoring said plurality of displacement-type shape sensors with an automatic shape control system of a leveler with which said plurality of displacement-type shape sensors are associated.

42. A displacement-type shape sensor for detecting the flatness of a strip of material, said sensor comprising:

a roller bearing assembly comprising a roller bearing supported within a roller bearing mount;

a guide for directing movement of said roller bearing assembly along a desired path;

a mounting member for receiving said guide and locating said roller bearing assembly either below or above said strip of material;

an actuator for displacing said roller bearing along said guide and against said strip of material; and a sensor for detecting an amount of linear movement of said roller bearing;

wherein a signal from said sensor for detecting an amount of linear movement of said roller bearing is output to an automatic shape control system of a leveler acting on said strip of material.

43. A flatness detection system for determining the flatness of a strip of material, said system comprising:

a plurality of displacement-type shape sensors disposed substantially across a width of said strip of material, each displacement-type shape sensor further comprising:

(a) a roller bearing assembly comprising a roller bearing supported within a roller bearing mount;

(b) a guide for restricting movement of said roller bearing assembly to a linear path;

(c) an actuator for displacing said roller bearing along said guide and against said strip of material; and (d) a linear displacement sensor for measuring an amount of linear movement of said roller bearing;

a mounting member for receiving said guides and thereby locating said displacement-type shape sensors either below or above said strip of material; and a means of displacing said roller bearings against said strip of material to cause a deflection thereof;

wherein after displacement of said roller bearings against said strip of material, an output signal from each said linear displacement sensor indicates the flatness of said strip of material in the area of its corresponding roller bearing; and wherein said output signal from each said linear displacement sensor is sent to an automatic shape control system of a leveler to which said flatness detection system is coupled.

44. A method of determining the flatness of a strip of material, said method comprising:

providing a plurality of displacement-type shape sensors that are disposed substantially across a width of said strip of material, each displacement-type shape sensor comprising:

(a) a roller bearing assembly comprising a roller bearing supported within a roller bearing mount;

(b) a guide for restricting movement of said roller bearing assembly to a desired path;

(c) an actuator for displacing said roller bearing along said guide and against said strip of material; and (d) a linear displacement sensor for measuring an amount of linear movement of said roller bearing;

providing a mounting member for locating said displacement-type shape sensors either below or above said strip of material;

causing said actuator to displace said roller bearings against said strip of material as said strip of material passes said displacement-type shape sensors;

determining the flatness of said strip of material by using each of said linear displacement sensors to measure the amount of linear movement of each respective roller bearing as it is displaced against said strip of material; and controlling and/or monitoring said plurality of displacement-type shape sensors with an automatic shape control system of a leveler with which said plurality of displacement-type shape sensors are associated.

* * * * *